US012593894B1

(12) United States Patent
Tseng

(10) Patent No.: US 12,593,894 B1
(45) Date of Patent: Apr. 7, 2026

(54) LUMINOUS SHOE STRAP AND SHOE WITH LUMINOUS SHOE STRAP

(71) Applicant: Shen-Ko Tseng, Taipei (TW)

(72) Inventor: Shen-Ko Tseng, Taipei (TW)

( * ) Notice: Subject to any disclaimer, the term of this patent is extended or adjusted under 35 U.S.C. 154(b) by 0 days.

(21) Appl. No.: 19/310,982

(22) Filed: Aug. 27, 2025

(30) Foreign Application Priority Data

Dec. 10, 2024 (TW) ..... 113213584
Jun. 9, 2025 (CN) ..... 202521161691.3

(51) Int. Cl.
*A43C 11/14* (2006.01)
*A43B 3/36* (2022.01)

(52) U.S. Cl.
CPC ..... *A43C 11/14* (2013.01); *A43B 3/36* (2022.01)

(58) Field of Classification Search
CPC .... A43B 3/36; A43B 3/40; A43B 3/44; A43C 11/14; A43C 11/1493; Y10S 362/802; Y10S 362/806
See application file for complete search history.

(56) References Cited

U.S. PATENT DOCUMENTS 5,033,212 A * 7/1991 Evanyk ..... A43D 999/00 36/137
5,709,464 A * 1/1998 Tseng ..... A42B 1/244 36/137
5,894,686 A * 4/1999 Parker ..... A43B 3/44 36/137
7,500,761 B2 * 3/2009 Tseng ..... A43B 3/36 362/249.14
9,445,641 B1 * 9/2016 Rapisarda ..... A43B 3/0031
12,363,814 B1 * 7/2025 Tseng ..... F21V 23/005
2004/0233658 A1 * 11/2004 Hsu ..... A43B 3/34 362/84
2015/0003047 A1 * 1/2015 Lin ..... F21V 23/0414 362/103
2020/0116341 A1 * 4/2020 Lin ..... F21V 23/0485

* cited by examiner

*Primary Examiner* — Ted Kavanaugh
(74) *Attorney, Agent, or Firm* — WPAT, PC

(57) ABSTRACT

A luminous heel strap includes a strap body, a strip component, and a luminous device. The strap body has a surface. The strip component is coupled to the strap body. The luminous device is disposed between the strap body and the strip component and includes a circuit board module, a battery, predetermined color LEDs, a sensor, and a control chip. The battery, the predetermined color LEDs, the sensor, and the control chip are electronically coupled to the circuit board module. The driving voltages of the predetermined color LEDs are the same. The sensor is configured to detect an external force to generate a control signal. The control chip drives the predetermined color LEDs to emit light according to the control signal. Wherein, the circuit board module a flexible circuit board or a circuit board with a flexible cable.

31 Claims, 23 Drawing Sheets

LUMINOUS SHOE STRAP AND SHOE WITH LUMINOUS SHOE STRAP

BACKGROUND OF THE INVENTION

1. Field of the Invention

The present invention relates to a shoe strap, especially to a luminous shoe strap having a luminous device disposed in the shoe strap and a shoe with luminous shoe strap.

2. Description of the Prior Art

With the continuous advancement of technology, the requirement for wearable devices is increasing. Wearable devices not only provide practical functions but can also serve as decorative accessories. For example, in recent years, luminous devices have been incorporated into shoes, allowing them to serve not only as a warning to passersby but also as a decorative feature.

Conventional luminous shoes typically utilize a rigid circuit board for their circuit design. The battery and controller are mounted on the rigid circuit board, while light-emitting diodes (such as LED chips) of a predetermined color are connected to the rigid circuit board by wires. Because the rigid circuit boards require packaging, they are typically placed on the sole of the shoe. However, this design will increase the weight of the shoe, take up space, and is inconvenient to install. Furthermore, once a conventional rigid circuit board is installed, it cannot be updated with new lighting patterns or adjusted in any other way.

Furthermore, as market requirement for more diverse and functional shoe designs grows, the application scenarios for luminous features are also expanding. For example, in addition to soles, designs integrating luminous features into shoelaces are also gaining popularity. The shoe strap is located on the upper part of the shoe, providing high visibility and thus more effective in displaying luminous effects. However, current conventional technology still relies on rigid circuit boards. The rigid structure of rigid circuit boards cannot be compatible with the flexibility of the shoelaces themselves, resulting in limited lace deformation and, in turn, restricting the flexibility of the luminous devices.

Furthermore, as users' requirement for personalized designs increases, the number, color, and lighting patterns of luminous devices are becoming more diverse. With current technology, when a larger number of light-emitting devices or multiple lighting patterns are required, rigid circuit boards must be connected to more wires to meet these design requirements. Furthermore, if the LEDs of a given color are positioned differently, the required wire lengths also vary. All of these issues not only lead to inconveniences in production and installation, but also significantly increase the weight of the shoes, potentially affecting their comfort and appearance.

Therefore, it is necessary to provide a new luminous shoe strap that can effectively achieve a lightweight design while adapting to the flexible structure of shoelaces, so as to solve the problems of increased weight, inconvenient installation and limited functions in the conventional technology.

SUMMARY OF THE INVENTION

Therefore, the present invention provides a luminous shoe strap and a shoe with luminous shoe strap to solve the problems of the prior art.

According to an embodiment of the present invention, the luminous shoe strap includes a strap body, a strip component and a luminous device. The strap body has a surface. The strip component is coupled to the strap body. The luminous device is disposed between the strap body and the strip component. The luminous device includes a circuit board module, a battery, a plurality of predetermined color light-emitting diodes, a sensor and a controlling chip. The battery is disposed on the circuit board module. The plurality of predetermined color light-emitting diodes are electrically coupled to the circuit board module and the battery. The plurality of predetermined color light-emitting diodes include a first predetermined color light-emitting diode and a second predetermined color light-emitting diode. The first predetermined color light-emitting diode includes a first light-emitting diode chip and a first phosphor layer coated on the first light-emitting diode chip. The second predetermined color light-emitting diode comprising a second light-emitting diode chip. Each of the predetermined color light-emitting diodes has the same or substantially the same driving voltage. The sensor is disposed on the circuit board module and configured to sense an external force to generate a controlling signal. The controlling chip is disposed on the circuit board module and electronically connected to the battery, the plurality of predetermined color light-emitting diodes and the sensor. The controlling chip is configured to receive the controlling signal and drive the plurality of predetermined color light-emitting diodes to emit light with a lighting mode according to the controlling signal. Wherein, the circuit board module is a flexible circuit board or a rigid circuit board with a flexible cable.

Wherein, the strap body has a groove formed on the surface, and the groove includes a first groove and a second groove communicated with each other. The luminous device is configured in the first groove and the second groove.

Wherein, when the circuit board module is the flexible circuit board, the first groove is configured to contain the battery and portion of the flexible circuit board, and the second groove is configured to contain the other portion of the flexible circuit board; or when the circuit board module is the rigid circuit board with the flexible cable, the first groove is configured to contain the rigid circuit board, and the second groove is configured to contain the flexible cable.

Wherein, the circuit board module is the flexible circuit board. The plurality of predetermined color light-emitting diodes are configured on a first surface of the flexible circuit board. The battery is configured on a second surface corresponding to the first surface of the flexible circuit board. The flexible circuit board further includes a first connecting component and a second connecting component. The first connecting component is connected to a first electrode of the battery and bypasses a side wall of the battery. The second connecting component is connected to a second electrode of the battery but not bypasses the side wall of the battery.

Wherein, the circuit board module is the flexible circuit board. The flexible circuit board further includes a first connecting component and a second connecting component. One end of the first connecting component is welded on a first surface of the flexible circuit board. One end of the second connecting component passes through the flexible circuit board and is welded on the first surface of the flexible circuit board. A case of the sensor is electronically connected to the first surface of the flexible circuit board. An electrode of the sensor is electronically connected to one of the first surface and the second surface of the flexible circuit board.

Wherein, the depth of the first groove is greater than the depth of the second groove.

Wherein, the circuit board module is the flexible circuit board. The flexible circuit board includes a slot, the sensor is configured in the slot, and the width of the slot is smaller than the width of the sensor. The width of the flexible circuit board is smaller than the width or diameter of the battery, and the length of the flexible circuit board is greater than the width or diameter of the battery.

Wherein, the circuit board module is the rigid circuit board with the flexible cable. The sensor and the controlling chip are configured on a first surface of the rigid circuit board. The plurality of predetermined color light-emitting diodes are configured on the flexible cable and/or the first surface of the rigid circuit board. The battery is configured on a second surface corresponding to the first surface of the rigid circuit board.

Wherein, the circuit board module is the rigid circuit board with the flexible cable. The rigid circuit board further includes a first connecting component and a second connecting component. The first connecting component is connected to a first electrode of the battery and bypasses a side wall of the battery. The second connecting component is connected to a second electrode of the battery but not bypass the side wall of the battery.

Wherein, the strap body further includes a first end and a second end. No hole in the first end and the second end of the strap body. The strip component further includes two holes corresponding to the first end and the second end. The luminous shoe strap further includes two joint components coupled to the two holes of the strip component respectively.

Wherein, two of the predetermined color light-emitting diodes are located corresponding to the first end and the second end respectively.

Wherein, the luminous device further includes a switch configured on the circuit board module and electronically connected to the battery and the controlling chip. The switch and one of the predetermined color light-emitting diodes are located corresponding to the first end and the second end respectively.

Wherein, the lighting color of the first predetermined color light-emitting diode is different from the lighting color of the second predetermined color light-emitting diode. The lighting color of the first predetermined color light-emitting diode is red-tinted, green-tinted, yellow-tinted, orange-tinted, cyan green-tinted, lime green-tinted, purple-tinted, pink-tinted, ice blue-tinted, or white-tinted. Wherein, the first light-emitting diode chip and the second light-emitting diode chip are blue light-emitting diode chips, and the second predetermined color light-emitting diode is not coated with a phosphor layer.

Wherein, the plurality of predetermined color light-emitting diodes further include a third predetermined color light-emitting diode. The third predetermined color light-emitting diode includes a third light-emitting diode chip and a third phosphor layer coated on the third light-emitting diode chip. Wherein, the lighting color of the third predetermined color light-emitting diode is different from the light color of the second predetermined color light-emitting diode.

Wherein, the lighting color of the first predetermined color light-emitting diode is orange-tinted, cyan green-tinted, lime green-tinted, purple-tinted, pink-tinted, ice blue-tinted, or white-tinted. The second predetermined color light-emitting diode further includes a second phosphor layer coated on the second light-emitting diode chip, and the lighting color of the second predetermined color light-emitting diode is orange-tinted, cyan green-tinted, lime green-tinted, purple-tinted, pink-tinted, ice blue-tinted, or white-tinted. Wherein, both of the first light-emitting diode chip and the second light-emitting diode chip are blue light-emitting diode chips.

Wherein, the lighting mode includes one of a sequential flashing mode, a synchronous flashing mode, a reciprocating flashing mode, an alternating flashing mode, a marquee flashing mode, a gradual brightening and dimming mode, and a gradual dimming and brightening mode.

According to an embodiment of the present invention, the shoe with luminous shoe strap includes a shoe body and a luminous shoe strap. The luminous shoe strap is coupled to the shoe body and includes a strap body, a strip component and a luminous device. The strap body has a surface. The strip component is coupled to the strap body. The luminous device is disposed between the strap body and the strip component. The luminous device includes a circuit board module, a battery, a plurality of predetermined color light-emitting diodes, a sensor and a controlling chip. The battery is disposed on the circuit board module. The plurality of predetermined color light-emitting diodes are electrically coupled to the circuit board module and the battery. The plurality of predetermined color light-emitting diodes include a first predetermined color light-emitting diode and a second predetermined color light-emitting diode. The first predetermined color light-emitting diode includes a first light-emitting diode chip and a first phosphor layer coated on the first light-emitting diode chip. The second predetermined color light-emitting diode comprising a second light-emitting diode chip. Each of the predetermined color light-emitting diodes has the same or substantially the same driving voltage. The sensor is disposed on the circuit board module and configured to sense an external force to generate a controlling signal. The controlling chip is disposed on the circuit board module and electronically connected to the battery, the plurality of predetermined color light-emitting diodes and the sensor. The controlling chip is configured to receive the controlling signal and drive the plurality of predetermined color light-emitting diodes to emit light with a lighting mode according to the controlling signal. Wherein, the circuit board module is a flexible circuit board or a rigid circuit board with a flexible cable.

Wherein, the strap body further includes a plurality of first holes, the strip component further comprises a plurality of second holes corresponding to the first holes. The first holes and the second holes are configured to connect a plurality of joint components to install the luminous shoe strap on the shoe body.

In one embodiment, the strap body further includes a first end and a second end. No hole in the first end and the second end of the strap body. The strip component further comprises two holes corresponding to the first end and the second end respectively. The two holes are configured to connect a plurality of joint components to install the luminous shoe strap on the shoe body.

Wherein, the luminous device further includes a switch configured on the circuit board module and electronically connected to the battery and the controlling chip. The switch or one of the predetermined color light-emitting diodes are located corresponding to the first end.

In summary, the luminous shoe strap of the present invention combines the flexible circuit board or the rigid circuit board with the flexible cable with the strap body and strip component of polymer materials (such as silicone, rubber, nylon, etc.), achieving the lightweight design. Furthermore, the circuit configuration and architecture of the circuit board of the luminous shoe strap allow the battery, the predetermined color light-emitting diodes, the sensor and the controlling chip to be installed directly on the circuit board without the external wires, thereby reducing the overall size and meeting the diverse shoelace size requirements of different age groups and foot shapes. Furthermore, the luminous shoe strap also can provide multiple lighting modes without increasing circuit complexity or adding external wires, allowing the controlling chip to select the corresponding lighting mode based on the controlling signal detected by the sensor. In addition, the luminous shoe strap also can be integrated on the shoe to provide a variety of lighting modes and practicality.

BRIEF DESCRIPTION OF THE APPENDED DRAWINGS

FIG. 9E-1 is a structural schematic diagram illustrating the strap body in another perspective of FIG. 9A.

FIG. 9E-2 is a structural schematic diagram illustrating the strap body in another perspective of FIG. 9A.

DETAILED DESCRIPTION OF THE INVENTION

For the sake of the advantages, spirits and features of the present invention can be understood more easily and clearly, the detailed descriptions and discussions will be made later by way of the embodiments and with reference of the diagrams. It is worth noting that these embodiments are merely representative embodiments of the present invention, wherein the specific methods, devices, conditions, materials and the like are not limited to the embodiments of the present invention or corresponding embodiments. Moreover, the devices in the figures are only used to express their corresponding positions and are not drawing according to their actual proportion.

Figure 1:
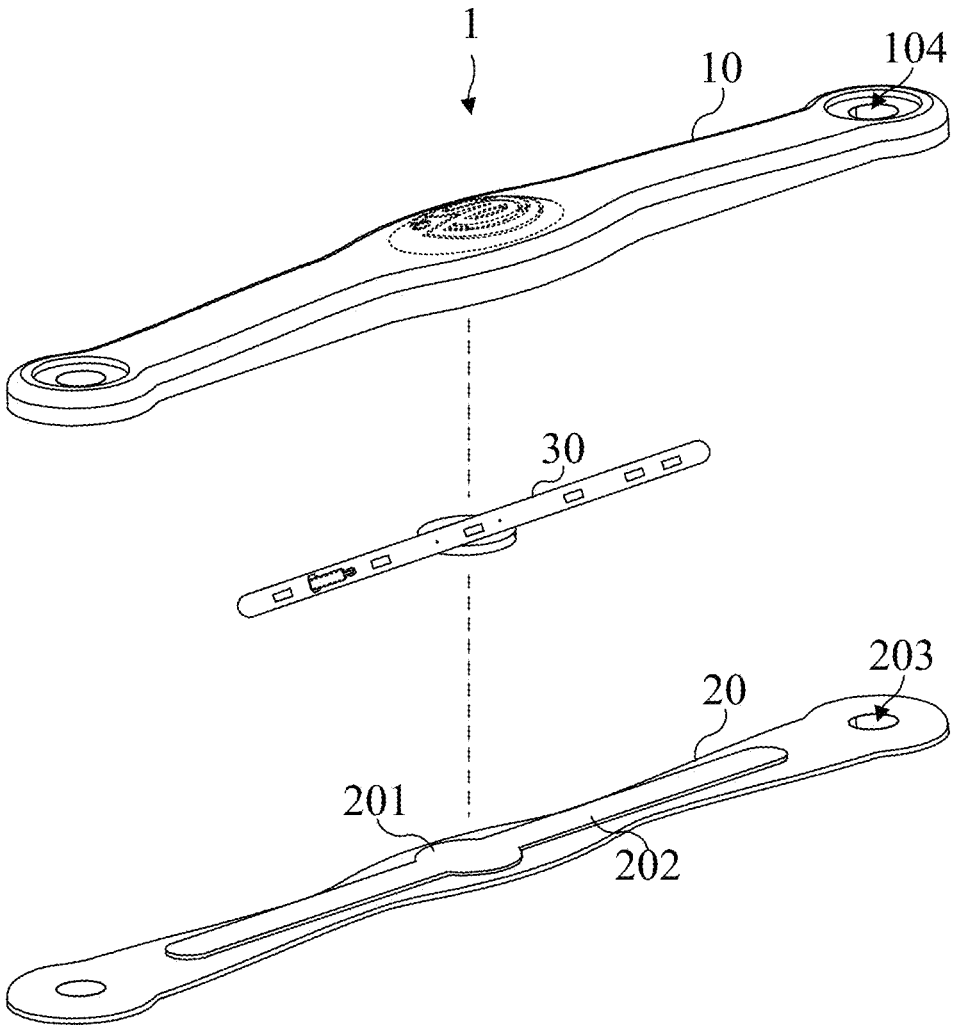
FIG. 1 is an exploded diagram illustrating a luminous shoe strap in an embodiment of the present invention.
Figure 2:
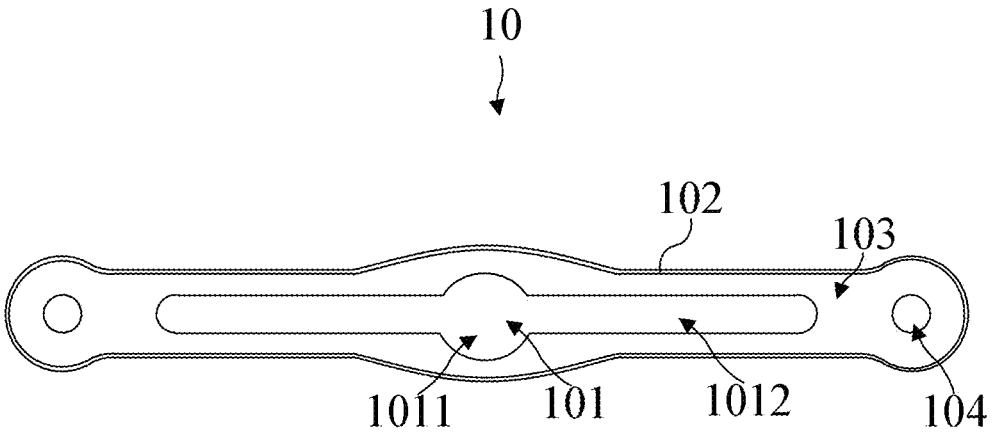
FIG. 2 is a top view diagram illustrating the strap body in FIG. 1.

Please refer to FIG. 1 and FIG. 2. FIG. 1 is an exploded diagram illustrating a luminous shoe strap 1 in an embodiment of the present invention. FIG. 2 is a top view diagram illustrating the strap body 10 in FIG. 1. As shown in FIG. 1, the luminous shoe strap 1 includes a strap body 10, a strip component 20 and a luminous device 30. The strap body 10 is elongated shape and has a surface, and the strip component 20 is disposed on the surface of the strap body 10. When the strip component 20 is coupled to the strap body 10, the luminous device 30 is located between the strap body 10 and the strip component 20.

Figure 3A:
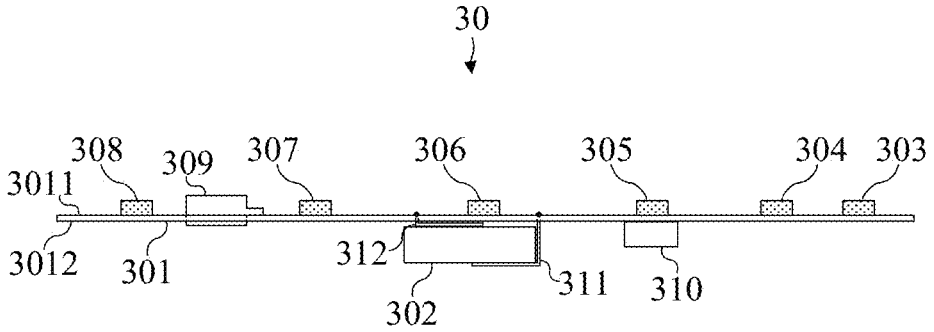
FIG. 3A is a structural schematic diagram illustrating the luminous device in FIG. 1.
Figure 3B:
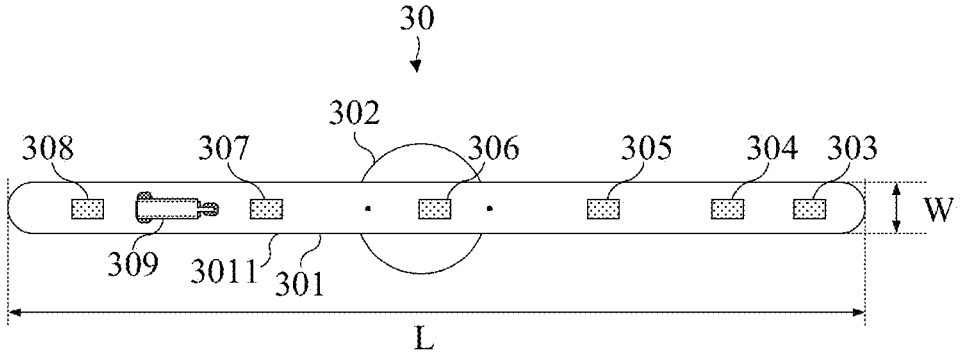
FIG. 3B is a structural schematic diagram illustrating the luminous device in another perspective of FIG. 3A.
Figure 3C:
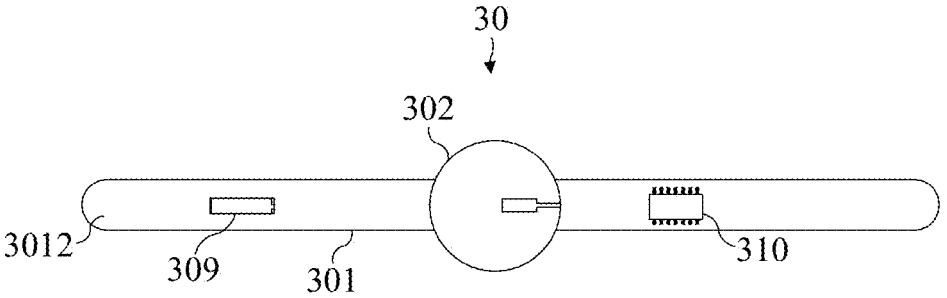
FIG. 3C is a structural schematic diagram illustrating the luminous device in another perspective of FIG. 3A.

Please refer to FIG. 3A, FIG. 3 and FIG. 3C. FIG. 3A is a structural schematic diagram illustrating the luminous device 30 in FIG. 1. FIG. 3B is a structural schematic diagram illustrating the luminous device 30 in another perspective of FIG. 3A. FIG. 3C is a structural schematic diagram illustrating the luminous device 30 in another perspective of FIG. 3A. As shown in FIG. 3A to FIG. 3C, the luminous device 30 includes a circuit board module 301 (with length L and width W), a battery 302, a plurality of predetermined color light-emitting diodes (303, 304, 305, 306, 307 and 308), a sensor 309 and a controlling chip 310. The battery 302, the predetermined color light-emitting diodes 303~308, the sensor 309 and the controlling chip 310 are configured on the circuit board module 301, and the width W of the circuit board module 301 is smaller than the width or diameter of the battery 302. The sensor 309 can be a motion sensor configured to detect an external force to generate a controlling signal. The controlling chip 310 is electronically connected to the battery 302, the predetermined color light-emitting diodes 303~308 and the sensor 309 through the circuit board module 301. The controlling chip 310 selects a lighting mode according to the controlling signal or sensing signal generated from the sensor 309, and drives the predetermined color light-emitting diodes 303~308 to emit light according to the lighting mode.

In this embodiment, the circuit board module 301 is a flexible circuit board, and the flexible circuit board can be a double-sided circuit board. As shown in FIG. 3A to FIG. 3C, the predetermined color light-emitting diodes 303~308 and the sensor 309 are disposed on a first surface 3011 of the circuit board module 301, and the battery 302 and the controlling chip 310 are disposed on a second surface 3012 corresponding to the first surface 3011. That is to say, when the luminous device 30 is configured on the surface of any product, the first surface 3011 can be located outward to emit light. Moreover, the battery 302 and the controlling chip 310 disposed on a second surface 3012 of the circuit board module 301 can save the space of the first surface 3011, thereby facilitating the layout of the predetermined color light-emitting diodes 303~308. In practice, the configuration of the predetermined color light-emitting diodes 303~308 is not limited to the single row arrangement shown in FIG. 3A to FIG. 3C, and can also be arranged more flexibly (such as double row arrangement, staggered arrangement) to make the light emitted by the luminous device 30 more variable.

Furthermore, the circuit board module 301 includes a first connecting component 311 and a second connecting component 312. The first connecting component 311 is connected to the positive electrode of the battery 302, the second connecting component 312 is connected to the negative electrode of the battery 302, and the first connecting component 311 and the second connecting component 312 are electronically connected to the circuit board module 301. In this embodiment, one end of the first connecting component 311 is connected or welded on the first surface 3011 of the circuit board module 301, and the other end of the first connecting component 311 bypasses the side wall of the battery 302 and is welded on the positive electrode of the battery 302. One end of the second connecting component 312 is connected or welded on the first surface 3011 of the circuit board module 301, but the other end of the second connecting component 312 not bypasses the side wall of the battery 302 to be welded on the negative electrode of the battery 302 directly. In one embodiment, the other end of the first connecting component 311 and the second connecting component 312 also can pass through the circuit board module 301 to connect the battery 302. In practice, the battery 302 can be a primary battery such as a carbon-zinc battery or an alkaline battery, or a rechargeable secondary battery or a rechargeable battery connected to a USB port. Moreover, the first surface 3011 and the second surface 3012 of the circuit board module 301 include a plurality of wires (not shown in figures) disposed on the circuit board module 301 respectively. The first connecting component 311, the second connecting component 312, the battery 302, the predetermined color light-emitting diodes 303~308, the sensor 309 and the controlling chip 310 can be electronically connected to each other by the wires.

In this embodiment, the circuit board module 301 includes a slot 313, and the sensor 309 is disposed in the slot 313. In practice, the width of the slot 313 is smaller than the width of the sensor 309 (that is the diameter of the cylindrical sensor 309). For example, the width (diameter) of the sensor 309 can be 1.96 mm, the width of the slot 313 can be 1.85 mm. When the sensor 309 is configured in the slot 313, portion of the sensor 309 can disposed in the slot 313 (as shown in FIG. 3A). In this embodiment, the predetermined color light-emitting diode 303, the controlling chip 310 and the sensor 309 can be disposed on the front surface (the first surface) of the circuit board module 301, and the battery 302 can be disposed flatly on the back surface (the second surface) of the circuit board module 301. Furthermore, the maximum width of the circuit board module 301 can be equal to or greater than the diameter of the battery 302, such as the circuit board module 301 covers the battery 302. In one embodiment, both of the length and width of the circuit board module 301 are equal to or greater than the diameter of the battery 302.

Please refer to FIG. 1, FIG. 2, FIG. 3A to FIG. 3C and FIG. 4A to FIG. 4D. FIG. 4A to FIG. 4D show the top view, front view, bottom view and side view of the luminous shoe strap 1 respectively. In this embodiment, the strap body 10 includes a groove 101, and the groove 101 includes a first groove 1011 and a second groove 1012 communicated with each other. Furthermore, the strip component 20 includes a protrusion structure, and the protrusion structure includes a first protrusion structure 201 and a second protrusion structure 202 connected with each other. The shapes of the first groove 1011 and the first protrusion structure 201 can be corresponding to the shape of the battery 302, and the shapes of the second groove 1012 and the second protrusion structure 202 can be corresponding to the shape of the circuit board module 301. In practice, the materials of the strap body 10 and the strip component 20 can be flexible polymer materials (such as silicone, rubber, nylon, etc.), and the shapes of the strap body 10 and the strip component 20 can be elongated shapes. When the luminous device 30 is configured in the groove 101, the first groove 1011 contains the battery 302 and portion of the flexible circuit board, and the second groove 1012 contains the other portion of flexible circuit board. When the strip component 20 is coupled to the strap body 10, the first protrusion structure 201 and the second protrusion structure 202 are coupled to the first groove 1011 and the second groove 1012 respectively, and the first protrusion structure 201 and the second protrusion structure 202 of the strip component 20 contact against the luminous device 30 disposed in the groove 101.

Figure 4A:
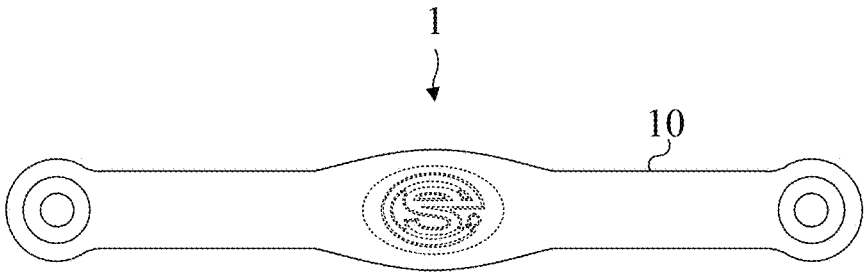
FIG. 4A is a top view diagram illustrating the luminous shoe strap in FIG. 1.
Figure 4B:
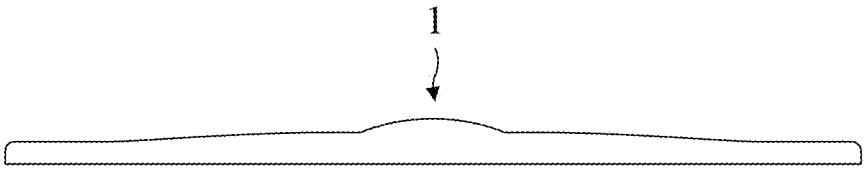
FIG. 4B is a front view diagram illustrating the luminous shoe strap in FIG. 1.
Figure 4C:
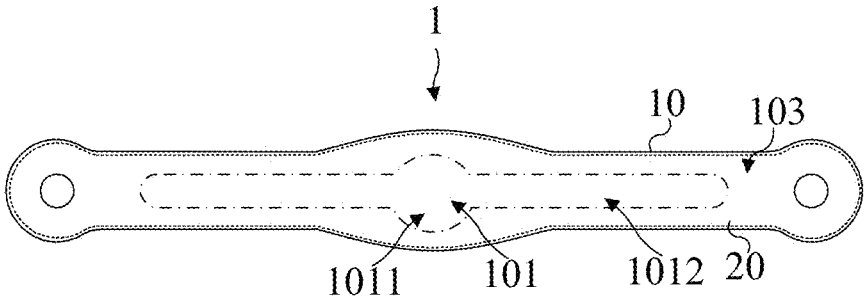
FIG. 4C is a bottom view diagram illustrating the luminous shoe strap in FIG. 1.
Figure 4D:
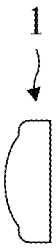
FIG. 4D is a side view diagram illustrating the luminous shoe strap in FIG. 1.

In this embodiment, the strap body 10 further includes an annular convex strip structure 102 surrounding the surface of the strap body 10, a concave portion 103 is formed in the annular convex strip structure 102, and the groove 101 is located in the concave portion 103. The shape of the concave portion 103 is corresponding to the shape of the strip component 20. When the strip component 20 is coupled to the strap body 10, the strip component 20 is disposed in the concave portion 103 to be mounted on the strap body 10. Wherein, as shown in FIG. 4C, the broken lines shows the area of the concave portion 103, and the strip component 20 is installed in the concave portion 103. Therefore, the luminous device (not shown in figure) can be stably disposed between the strap body 10 and the strip component 20. In practice, the depths of the first groove 1011 and the second groove 1012 of the strap body 10 can match up with the height of the luminous device. For example, when the height of the battery is greater than that of the flexible circuit board, the depth of the second groove 1012 is smaller than or equal to the depth of the first groove 1011.

In this embodiment, the strap body 10 has a plurality of first holes 104, and the strip component 20 has second holes 203 corresponding to the first holes 104. After the strap body 10 is coupled to the strip component 20, a joint component (not shown in figure) can pass through the first hole 104 and the second hole 203, and then the joint component can be connected and fixed to the shoe body, so that the luminous shoe strap 1 is set on the shoe body. The manner in which the luminous shoe strap 1 attached to the shoe body is not limited thereto. In one embodiment, the luminous shoe strap further includes a plurality of buckle components (such as outwardly protruding cylinders), and the shoe body can include mounting holes corresponding to the buckle components. Therefore, the luminous shoe strap can be fixed on the shoe body by snapping the buckle components into the mounting holes.

The luminous shoe strap of the present invention utilizes the flexible circuit board and internal circuitry, allowing the battery, the predetermined color light-emitting diodes, the sensor and the controlling chip to be directly mounted on the surface of the flexible circuit board, and the predetermined color light-emitting diodes located at different locations on the flexible circuit board correspond to different locations on the wearable device. Therefore, the flexible circuit board simplifies the overall circuit design, reduces external wiring, and reduces overall size. Furthermore, this luminous shoe strap combines the flexible circuit board with a flexible polymer material strap body and strip component, resulting in a lightweight design that adapts to various shoe strap types.

Figure 5:
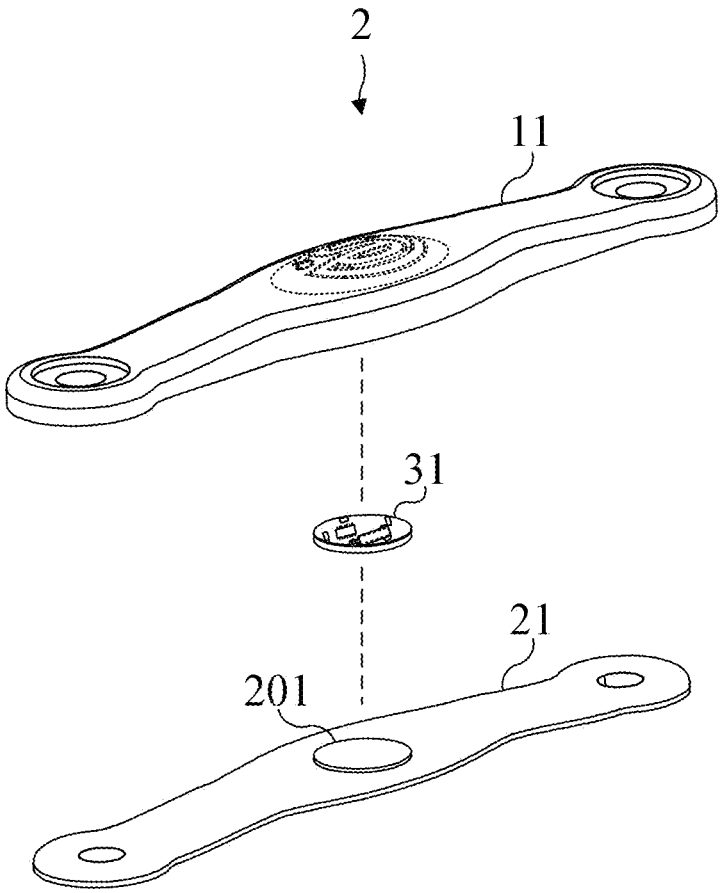
FIG. 5 is an exploded diagram illustrating the luminous shoe strap in an embodiment of the present invention.
Figure 6:
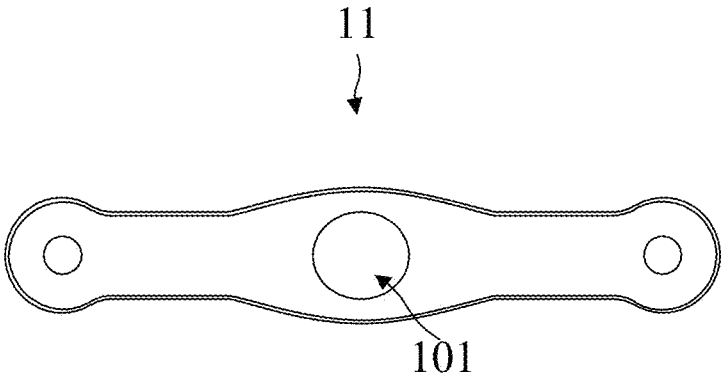
FIG. 6 is a top view diagram illustrating the strap body in FIG. 5.
Figure 7A:
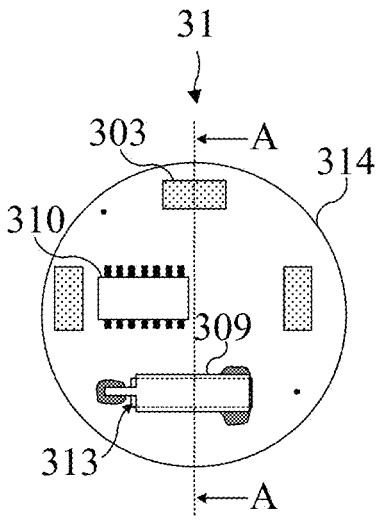
FIG. 7A is a structural schematic diagram illustrating the luminous device in FIG. 5.
Figure 7B:
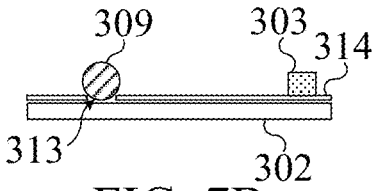
FIG. 7B is a sectional schematic diagram illustrating the luminous device along line A-A in FIG. 7A.
Figure 7C:
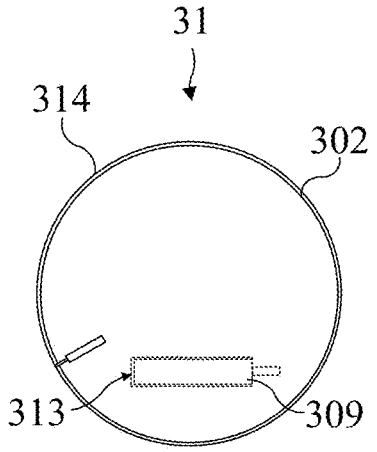
FIG. 7C is a structural schematic diagram illustrating the luminous device in another perspective of FIG. 7A.
Figure 8A:
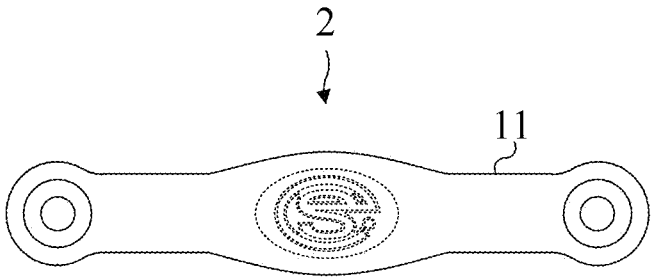
FIG. 8A is a top view diagram illustrating the luminous shoe strap in FIG. 5.
Figure 8B:
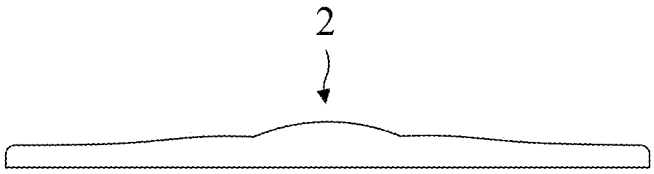
FIG. 8B is a front view diagram illustrating the luminous shoe strap in FIG. 5.
Figure 8C:
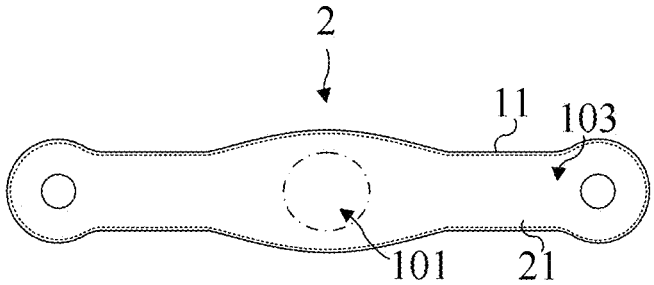
FIG. 8C is a bottom view diagram illustrating the luminous shoe strap in FIG. 5.
Figure 8D:
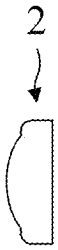
FIG. 8D is a side view diagram illustrating the luminous shoe strap in FIG. 5.

The luminous shoe strap of the present invention also can adjust the overall size of the luminous device according to requirements. Please refer to FIG. 5, FIG. 6, FIG. 7A to FIG. 7C and FIG. 8A to FIG. 8D. FIG. 5 is an exploded diagram illustrating the luminous shoe strap 2 in an embodiment of the present invention. FIG. 6 is a top view diagram illustrating the strap body 11 in FIG. 5. FIG. 7A is a structural schematic diagram illustrating the luminous device 31 in FIG. 5. FIG. 7B is a sectional schematic diagram illustrating the luminous device 31 along line A-A in FIG. 7A. FIG. 7C is a structural schematic diagram illustrating the luminous device 31 in another perspective of FIG. 7A. FIG. 8A to FIG. 8D show the top view, front view, bottom view and side view of the luminous shoe strap 2. In this embodiment, the shape of the circuit board module 314 of the luminous device 31 is circular shape, and the size of the circuit board module 314 is close to the diameter of the battery 302. The strap body 11 of the luminous shoe strap 2 is shorter and has only one groove 101, and the strip component 21 has only one protrusion structure 201. When the luminous device 31 is disposed in the groove 101, the groove 101 contains the entire luminous device 31, and the protrusion structure 201 of the strip component 21 contacts against the luminous device 31.

Furthermore, the battery 302 is configured on the first surface of the circuit board module 314, and the at least one predetermined color light-emitting diode 303, the sensor 309 and the controlling chip 310 are configured on the second surface of the circuit board module 314. The predetermined color light-emitting diode 303 can be arranged around the edge of the circuit board module 314. Similarly, the circuit board module 314 also can include a slot 313, and portion of the sensor 309 can located in the slot 313. It should be noted that the functions of the other components in this embodiment are the same as the functions of corresponding components in aforementioned embodiment, there are not described hereto. Therefore, the luminous shoe strap of the present invention can adjust the size of the flexible circuit board according to requirements to meet diverse requirements.

Figure 9A:
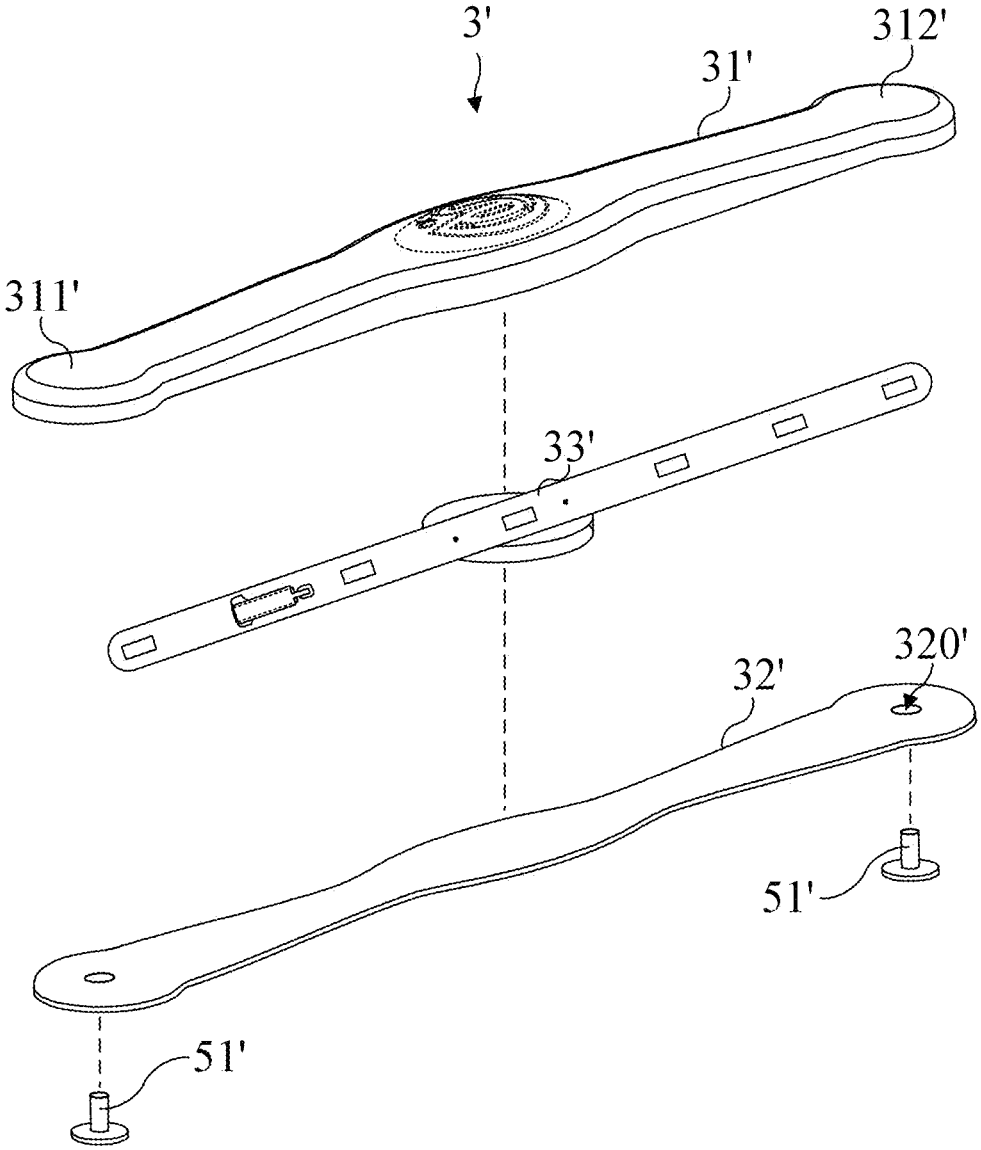
FIG. 9A is an exploded diagram illustrating the luminous shoe strap in an embodiment of the present invention.
Figure 9B:
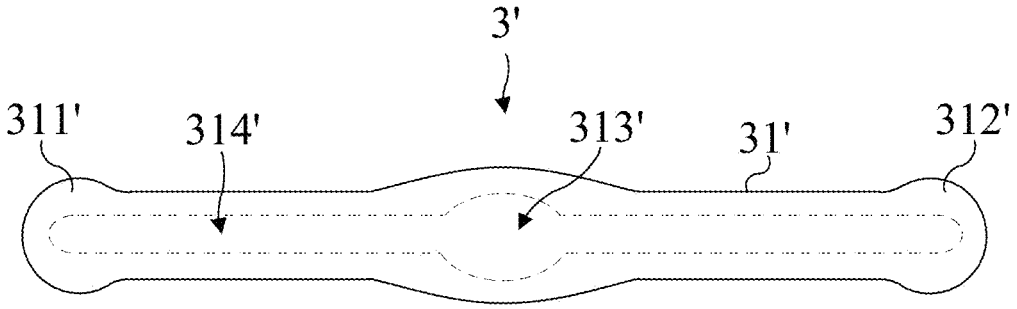
FIG. 9B is a top view diagram illustrating the luminous shoe strap in FIG. 9A.
Figure 9C:
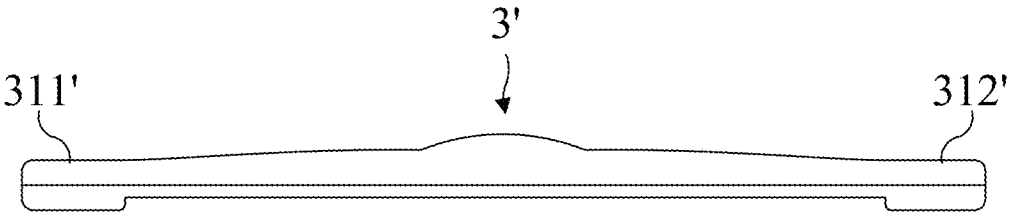
FIG. 9C is a front view diagram illustrating the luminous shoe strap in FIG. 9A.
Figure 9D:
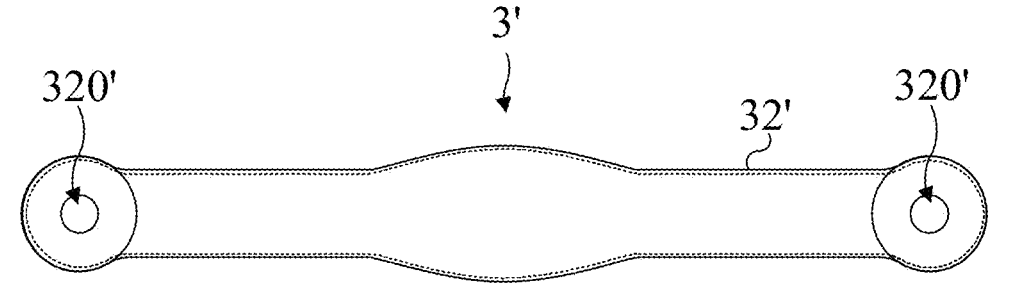
FIG. 9D is a bottom view diagram illustrating the luminous shoe strap in FIG. 9A.
Figures 1, 9E:
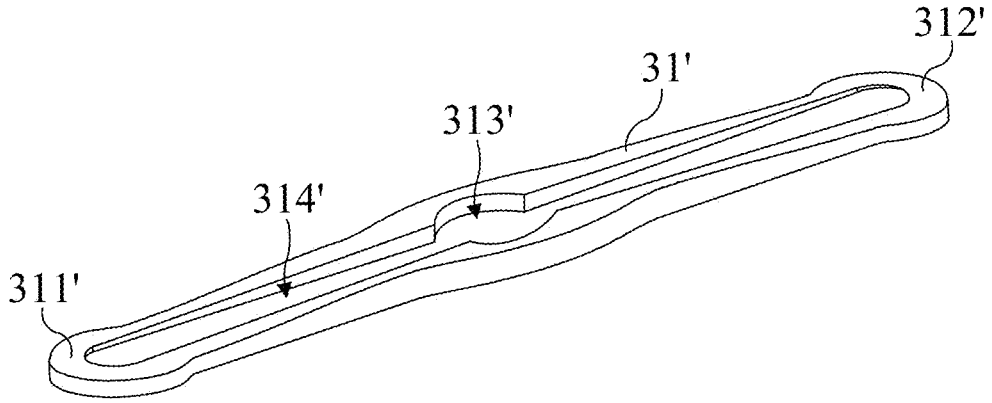
Figures 2, 9E:
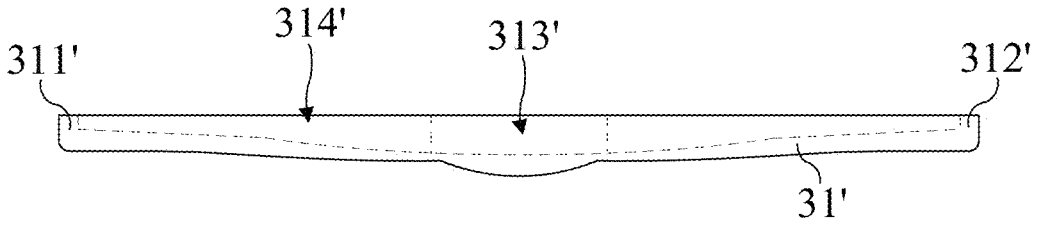
Figure 9F:
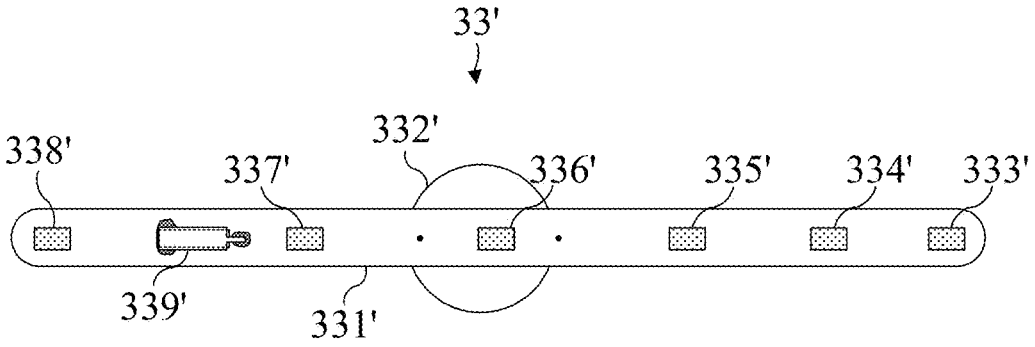
FIG. 9F is a structural schematic diagram illustrating the luminous device in another perspective of FIG. 9A.
Figure 9G:
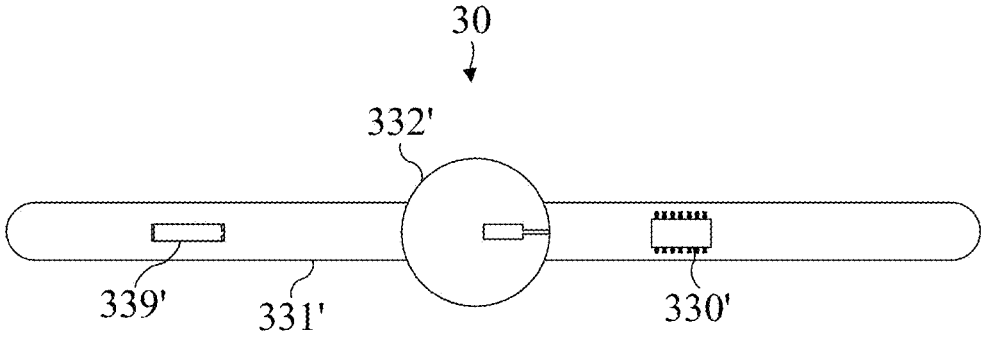
FIG. 9G is a structural schematic diagram illustrating the luminous device in another perspective of FIG. 9A.

The luminous shoe strap of the present invention also can be other forms. Please refer to FIG. 9A to FIG. 9G. FIG. 9A is an exploded diagram illustrating the luminous shoe strap 3' in an embodiment of the present invention. FIG. 9B is a top view diagram illustrating the luminous shoe strap 3' in FIG. 9A. FIG. 9C is a front view diagram illustrating the luminous shoe strap 3' in FIG. 9A. FIG. 9D is a bottom view diagram illustrating the luminous shoe strap 3' in FIG. 9A. FIG. 9E-1 is a structural schematic diagram illustrating the strap body 31' in another perspective of FIG. 9A. FIG. 9E-2 is a structural schematic diagram illustrating the strap body 31' in another perspective of FIG. 9A, and FIG. 9E-2 is the side view of the strap body 31'. FIG. 9F is a structural schematic diagram illustrating the luminous device 33' in another perspective of FIG. 9A. FIG. 9G is a structural schematic diagram illustrating the luminous device 33' in another perspective of FIG. 9A. As shown in FIG. 9A to FIG. 9F, in this embodiment, the strap body 31' includes a first end 311' and a second end 312'. Similarly, the strap body 31' also has the first groove 313' and the second groove 314' configured to contain the luminous device 33'. The two ends of the second groove 314' are located at the first end 311' and the second end 312' respectively. The difference between this embodiment and the aforementioned embodiment is that only the strip component 32' includes holes 320', while the strap body 31' does not include the holes. The positions of the two holes 320' are corresponding to the first end 311' and the second end 312' respectively. In practice, the strip component 32' also can include the protrusion structure corresponding to the groove.

Furthermore, as shown in FIG. 9E-1 and FIG. 9E-2, in this embodiment, the depth of the first groove 313' is greater than the depth of the second groove 314'. When the luminous device 33' is disposed in the strap body 31', the battery 332' and a portion of the circuit board module 331' can be completely accommodated in the first groove 313', and another portion of the circuit board module 331' can be accommodated in the second groove 314'. Thus, due to the depth difference between the first groove 313' and the second groove 314', the circuit board module 331' will not be damaged even the bending of the strap body 31'. In practice, the depth of second groove 314' can be gradually changed, for example, the depth of the second groove 314' can gradually deeper from the first end 311' (or the second end 312') to the first groove 313'.

Figure 15:
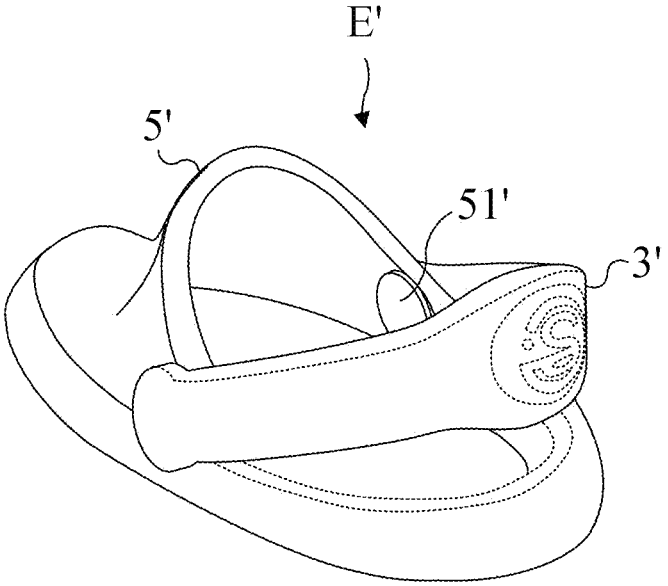
FIG. 15 is a schematic diagram illustrating the shoe with luminous shoe strap in an embodiment of the present invention.

After the strap body 31' is coupled to the strip component 32', two joint components 51' can be engaged to the holes 320', and then the joint components 51' can be connected and fixed to the shoe body, so that the luminous shoe strap 1 is coupled to or fixed to the shoe body (see FIG. 15). In practice, the joint component 51' can be a buckle having T shape to be mounted on the hole 320'.

As shown in FIG. 9A, FIG. 9F and FIG. 9G, in this embodiment, the luminous device 33' includes the circuit board module 331' and the predetermined color light-emitting diodes 333'~338', and the two predetermined color light-emitting diodes 333', 338' are disposed at the first end 311' and the second end 312' of the circuit board module 331'. When the controlling chip drives the luminous device 33' to emit light, the two ends (the first end 311' and the second end 312') of the luminous shoe strap 3' also can emit light because of exist of the predetermined color light-emitting diodes 333' and 338', to provide different visual effects. It is should be noted that the luminous device 33' also include the battery 332', the sensor 339', the first connecting component, the second connecting component and the controlling chip 330'. The functions and configuration of those components are the same as the functions and configuration of corresponding components in aforementioned embodiments, there are not described hereto.

Figure 10:
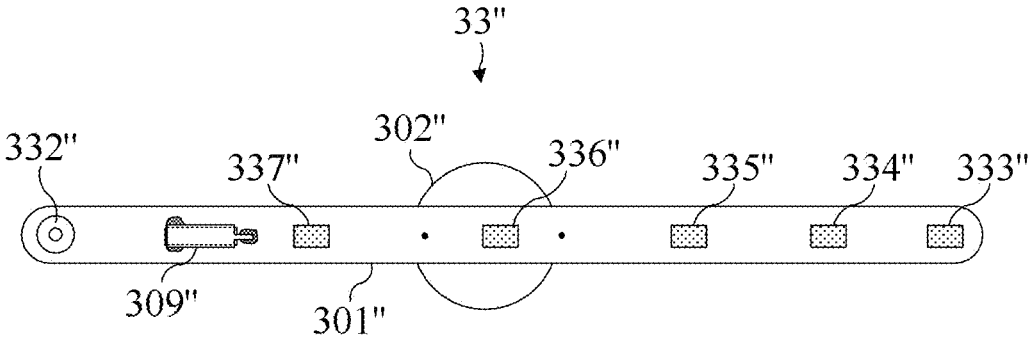
FIG. 10 is a structural schematic diagram illustrating the luminous device in an embodiment of the present invention.

The luminous device of the present invention also can be other forms. Please refer to FIG. 10. FIG. 10 is a structural schematic diagram illustrating the luminous device 33" in an embodiment of the present invention. As shown in FIG. 10, the luminous device 33" further includes a switch 332" configured on the circuit board module 301" and electronically connected to the battery 302". Furthermore, the switch 332" and the predetermined color light-emitting diode 333" are located two ends of the circuit board module 301". In practice, the switch 332" and the predetermined color light-emitting diode 333" can be disposed corresponding to the first end and the second end of the strap body (the switch 332" can be disposed at the first end 311' or the second end 312' in FIG. 9A, for example). Therefore, the user can press the first end or the second end of the strap body to trigger the switch 332" to generate a signal, and then the controlling chip can drive the predetermined color light-emitting diodes 333"~337" to emit light according to the signal.

In practice, the switch 332" can be an ON/OFF switch. When the switch 332" is turned off, the battery 302" does not provide the power. At this time, the controlling chip will not drive the predetermined color light-emitting diodes 333"~337" to emit light even though the sensor 309" detects the external force. When the switch 332" is turned on, the battery 302" supplies power normally, and the sensor 309" and the control chip resume normal operation.

Furthermore, the switch 332" also can be a selecting switch. When the switch 332" is pressed, the switch 332" will generate a switch signal, and the controlling chip can select or change the lighting mode according to the switch signal. For example, when the switch 332" is pressed once, the controlling chip will select the first lighting mode and drive the predetermined color light-emitting diodes 333"~337" to emit light with the first lighting mode when the sensor 309" detects the external force. Moreover, the switch 332" also can be combined with the ON/OFF switch and the selecting switch. In practice, when the switch 332" is turned on, the controlling chip selects an initial lighting mode and drives the predetermined color light-emitting diodes 333"~337" to emit light when the sensor 309" detects the external force. Then, when the switch 332" is pressed, the controlling chip selects the lighting mode corresponding to the switch signal and drives the predetermined color light-emitting diodes 333"~337" to emit light when the sensor 309" detects the external force.

Figure 11A:
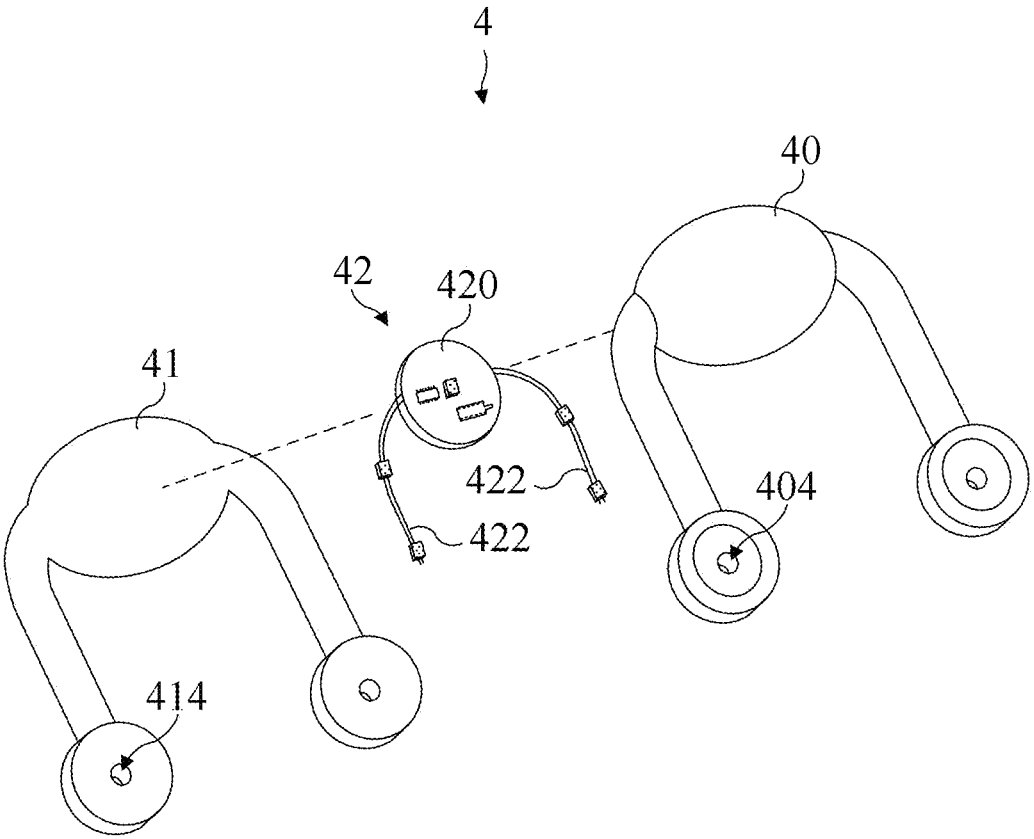
FIG. 11A is an exploded diagram illustrating the luminous shoe strap in an embodiment of the present invention.
Figure 11B:
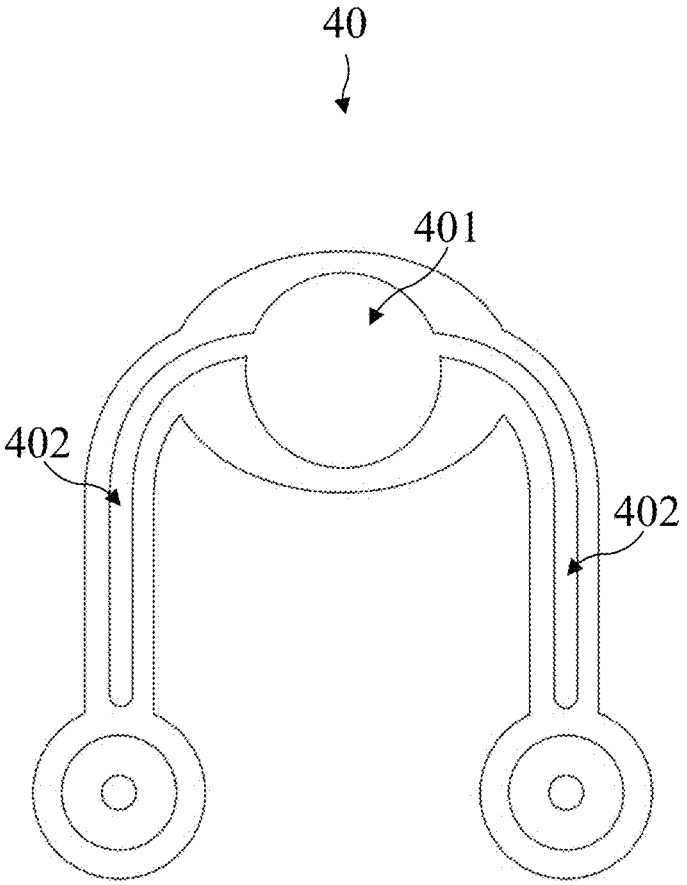
FIG. 11B is a structural schematic diagram illustrating the strap body in FIG. 11A.
Figure 11C:
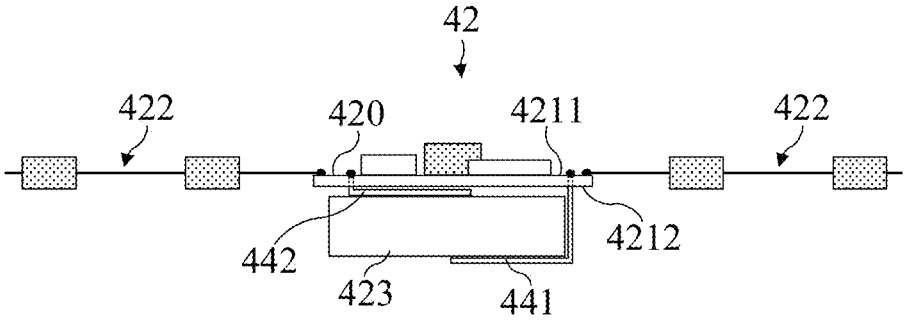
FIG. 11C is a structural schematic diagram illustrating the rigid circuit board with a flexible cable in FIG. 11A.
Figure 11D:
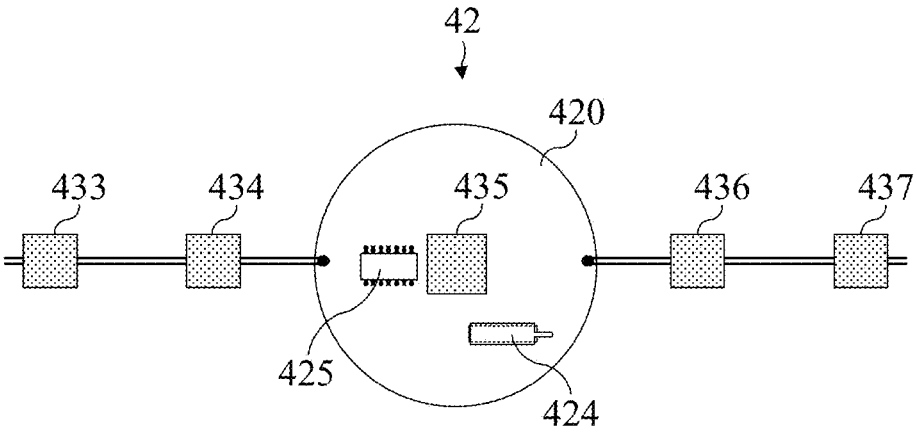
FIG. 11D is a structural schematic diagram illustrating the rigid circuit board with the flexible cable in another perspective of FIG. 11C.
Figure 11E:
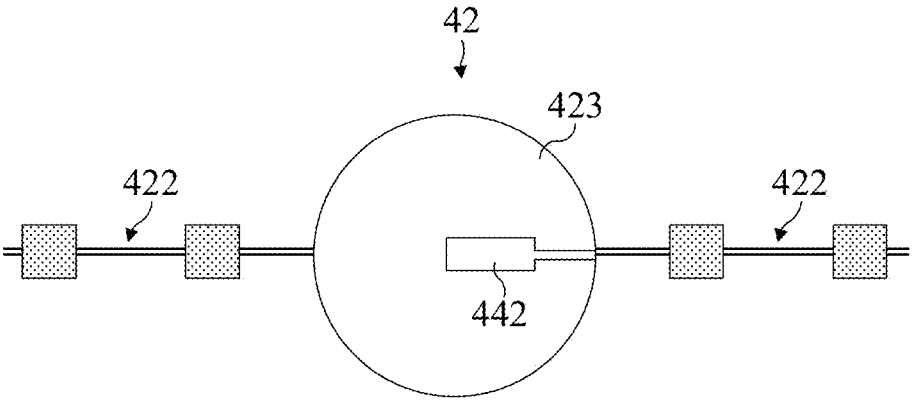
FIG. 11E is a side view diagram illustrating the rigid circuit board in FIG. 11C.
Figure 12A:
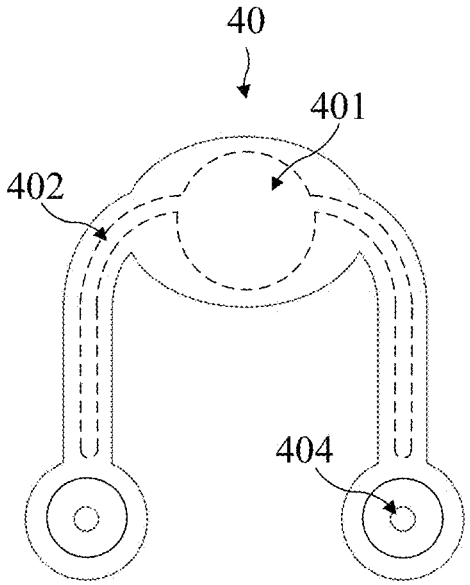
FIG. 12A is a front view diagram illustrating the luminous shoe strap in FIG. 11A.
Figure 12C:
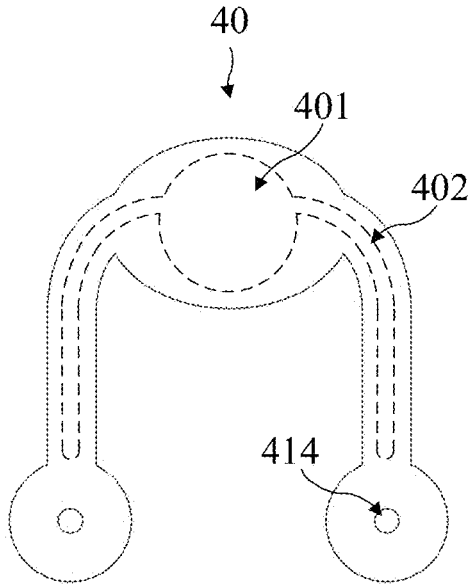
FIG. 12C is a rare view diagram illustrating the luminous shoe strap in FIG. 11A.
Figure 12B:
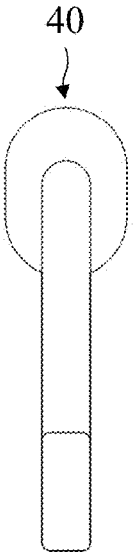
FIG. 12B is a side view diagram illustrating the luminous shoe strap in FIG. 11A.
Figure 12D:
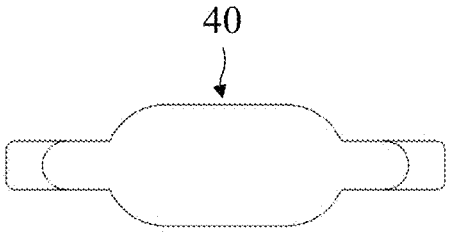
FIG. 12D is a top view diagram illustrating the luminous shoe strap in FIG. 11A.
Figure 12E:
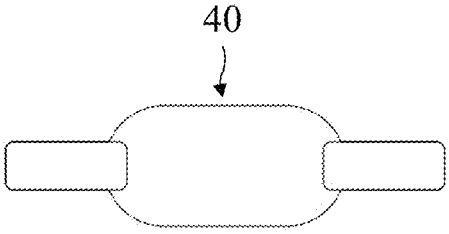
FIG. 12E is a bottom view diagram illustrating the luminous shoe strap in FIG. 11A.

Please refer to FIG. 11A to FIG. 11E and FIG. 12A to FIG. 12E, the figures show another embodiment of luminous shoe strap. FIG. 11A is an exploded diagram illustrating the luminous shoe strap 4 in an embodiment of the present invention. FIG. 11B is a structural schematic diagram illustrating the strap body 40 in FIG. 11A. FIG. 11C is a structural schematic diagram illustrating the rigid circuit board 420 with a flexible cable 422 in FIG. 11A. FIG. 11D is a structural schematic diagram illustrating the rigid circuit board 420 with the flexible cable 422 in another perspective of FIG. 11C. FIG. 11E is a side view diagram illustrating the rigid circuit board 420 in FIG. 11C. FIG. 12A to FIG. 12E show the front view, side view, rare view, top view and bottom view of the luminous shoe strap 4 in FIG. 11A respectively. As shown in FIG. 11A to FIG. 11E and FIG. 12A to FIG. 12E, in this embodiment, the circuit board module of the luminous device 42 is the rigid circuit board 420 with the flexible cable 422. The circuit board module includes two flexible cables 422 symmetrically disposed at both ends of the rigid circuit board 420. The sensor 424 and the controlling chip 425 are configured on the first surface 4211 of the rigid circuit board 420, the battery 423 is configured on the second surface 4212 of the rigid circuit board 420, and the predetermined color light-emitting diodes 433~437 are configured on the first surface 4211 of the rigid circuit board 420 and the two flexible cables 422. In practice, the first surface 4211 of the rigid circuit board 420 can include wires (not shown in figure), and one end of the two flexible cables 422 is welded on the first surface 4211 of the rigid circuit board 420. Therefore, the sensor 424, the controlling chip 425 and the two flexible cables 422 can be electronically connected to each other by wires. Each of flexible cable 422 can further include a first flexible cable and a second flexible cable connected to the positive electrode and the negative electrode respectively. The predetermined color light-emitting diodes 433~437 can be set on the first surface 4211 of the rigid circuit board 420 and the two flexible cables 422 in an equidistant manner. It should be noted that the luminous device 42 can further include an insulating layer (not shown in figures) covering the two flexible cables 422. In practice, the insulating layer can be transparent soft adhesive layer to prevent the flexible cable 422 and the predetermined color light-emitting diodes disposed thereon from short circuiting.

Moreover, the rigid circuit board 420 includes a first connecting component 441 and a second connecting component 442. One end of the first connecting component 441 is connected or welded on the first surface 4211 (or the second surface 4212) of the rigid circuit board 420, and the other end of the first connecting component 441 bypasses the side wall of the battery 423 and is connected to the positive electrode of the battery 423. One end of the second connecting component 442 is connected or welded on the first surface 4211 (or the second surface 4212) of the rigid circuit board 420, and the other end of the second connecting component 442 not bypasses the side wall of the battery 423 and is connected directly to the negative electrode of the battery 423. One end of the first connecting component 441 and the second connecting component 442 also can electronically connected to the wires of the rigid circuit board 420 to provide the power the two flexible cables 422, the predetermined color light-emitting diodes 433~437, the sensor 424 and the controlling chip 425. The maximum width of the rigid circuit board 420 can be greater than or equal to the diameter of the battery 423.

In this embodiment, the shapes of the strap body 40 and the strip component 41 are U shape, and the strap body 40 includes a first groove 401 and a second groove 402 communicated with each other. When the luminous shoe strap 4 is assembled, the first groove 401 of the strap body 40 contains the rigid circuit board 420 (or the battery 423), and the second groove 402 contains the flexible cables 422. Furthermore, the strip component 41 also can include a protrusion structure (not shown in figure) corresponding to the first groove 401 and the second groove 402, and the protrusion structure of the strip component 41 can contact against the luminous device 42. In addition, the strap body 40 can have a plurality of first holes 404, and the strip component 41 has a plurality of second holes 414 corresponding to the first holes 404. After the strap body 40 is coupled to the strip component 41, a joint component (not shown in figure) can pass through the first hole 404 and the second hole 414, and then the joint component can be connected and fixed to the shoe body, so that the luminous shoe strap 4 is set on the shoe body.

The predetermined color light-emitting diodes of the luminous device of the resent invention can generate various colors of light to present a variety of visual effects. Moreover, the luminous device can provide a variety of lighting modes to enhance the aesthetics and visual effects of the luminous shoe strap. The following details the predetermined color light-emitting diodes and lighting modes of the luminous device.

Please refer to FIG. 3A to FIG. 3C again. In this embodiment, the predetermined color light-emitting diodes 303~308 of the luminous device 30 include light-emitting diode chip respectively, and at least one predetermined color light-emitting diode include a phosphor layer, so that the predetermined color light-emitting diodes 303~308 can emit different colors of light, such as red-tinted, green-tinted, yellow-tinted, orange-tinted, cyan green-tinted, lime green-tinted, purple-tinted, pink-tinted, ice blue-tinted, white-tinted etc. All the predetermined color light-emitting diodes 303~308 include the same light-emitting diode chips, such as the blue light-emitting diode chip. Furthermore, the surface of the blue light-emitting diode chip can be selectively coated the phosphor layer with different colors or proportions, and the phosphor in the phosphor layer can absorb and combine the blue light emitted by the blue light-emitting diode chip to form light of other colors. For example, the blue light-emitting diode chip is coated with the pink-tinted phosphor layer to emit pink-tinted light, and the blue light-emitting diode chip is coated with the green-tinted phosphor layer to emit green-tinted light. Since all the predetermined color light-emitting diodes of the luminous device 30 have the same light-emitting diode chips, the predetermined color light-emitting diodes have the same or substantially same driving voltages or operating voltages (Vf). It should be noted that even if all the predetermined color light-emitting diodes are the same blue light-emitting diode chip, the driving voltage may still have slight differences due to the manufacturing process. Taking a median driving voltage of 3V as an example, the driving voltage of the blue light-emitting diode chip may vary by plus or minus 1% to 5%, such as between 2.85V and 3.15V, 2.9V and 3.1V, or 2.97V and 3.03V, but they can still be considered essentially the same driving voltage. Using this technical approach, even if the predetermined color light-emitting diodes emit multiple colors, the battery can still maintain a stable output voltage, it not only extends the lifespan of the luminous device but also significantly reduces circuit board design time and costs.

Moreover, in this embodiment, at least one of the predetermined color light-emitting diodes 303~308 only includes blue light-emitting diode chip and not includes the phosphor layer. Taking the FIG. 3 as an example, the predetermined color light-emitting diodes 303~308 includes a first predetermined color light-emitting diode 303, a second predetermined color light-emitting diode 304, a third predetermined color light-emitting diode 305, a fourth predetermined color light-emitting diode 306, a fifth predetermined color light-emitting diode 307 and a sixth predetermined color light-emitting diode 308, wherein the first, the third to sixth predetermined color light-emitting diodes include the phosphor layer to emit other colors lights besides blue light, and the second predetermined color light-emitting diode does not include the phosphor layer to emit blue light. Conventional technology utilizes the light-emitting diode that can emit light of different colors to produce different colors. When switching between different colors of light-emitting diodes, the battery also needs to switch the corresponding output voltage to drive the light-emitting diode chip. When switching frequently, the battery voltage change speed is slower than the switching speed, which will shorten the service life of the light-emitting diode and battery. Therefore, the luminous device of the present invention can continuously and stably output the same voltage to the predetermined color light-emitting diode, thereby extending the service life of the luminous device.

It is should be noted that the structures and functions of the predetermined color light-emitting diodes 433~437 in FIG. 11A to FIG. 11E are the same as the structures and functions of the predetermined color light-emitting diodes 303~308 in FIG. 3A to FIG. 3C, there are not described hereto.

Please refer to FIG. 3A, FIG. 11A, FIG. 13A to FIG. 13H. FIG. 13A to FIG. 13H are schematic diagrams illustrating a plurality of lighting modes of the plurality of predetermined color light-emitting diodes (the predetermined color light-emitting diodes 303~308 in FIG. 3A or the predetermined color light-emitting diodes 433~437 in FIG. 11A), wherein the horizontal axis represents time and the vertical axis represents the number of the predetermined color light-emitting diode. In this embodiment, each square wave peak in figure represents that the predetermined color light-emitting diode emits light, and each figure represents a wave train of one light emitting mode. Furthermore, the lighting modes can be pre-stored or stored in the controlling chip 310 (such as the memory of the controlling chip). When the controlling chip 310 receives the controlling signal generated by the sensor 309, the controlling chip 310 can drive the predetermined color light-emitting diodes 303~308 to emit light with the lighting mode. In one embodiment, the predetermined color light-emitting diodes can also emit light at the trough of the square wave.

Figure 13A:
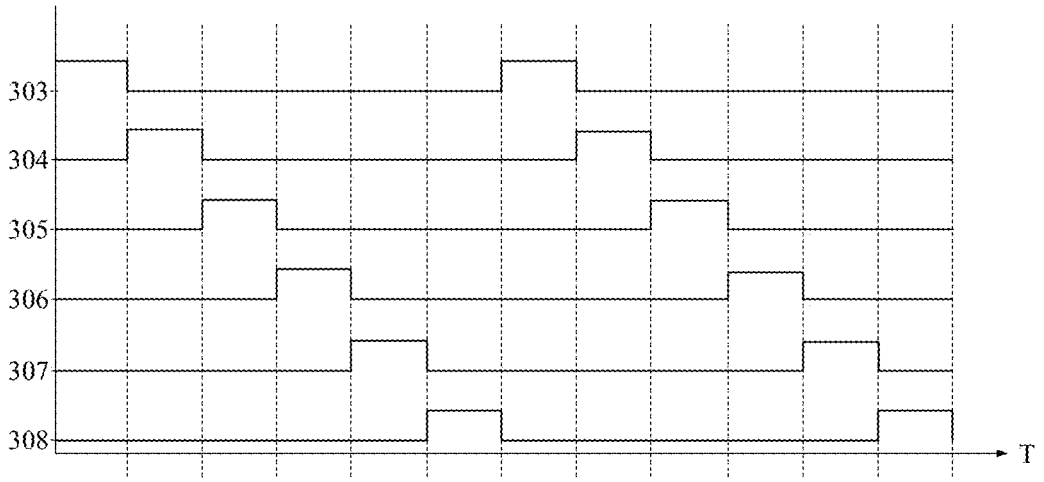
FIG. 13A to FIG. 13H are schematic diagrams illustrating a plurality of lighting modes of the plurality of predetermined color light-emitting diodes.
Figure 13B:
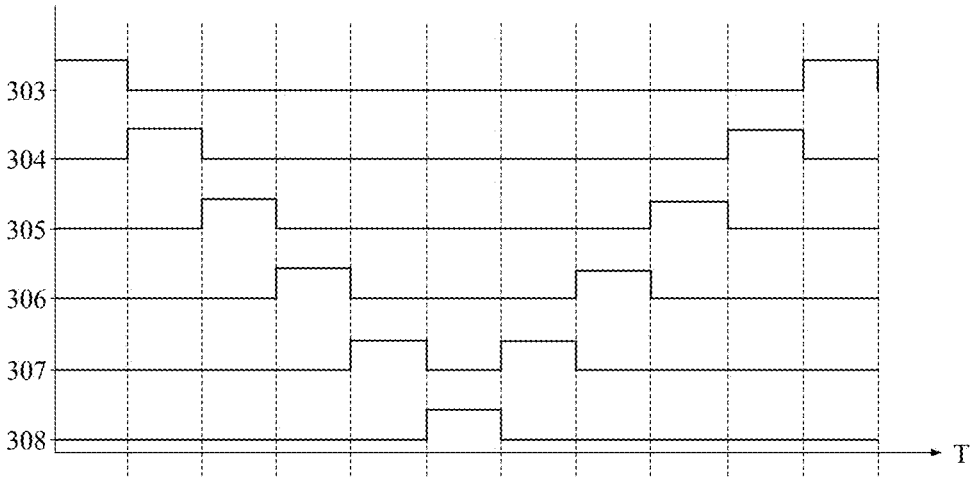

As shown in FIG. 13A, the predetermined color light-emitting diodes 303~308 can each emit light once in sequence to form a lighting cycle, and then repeat the lighting cycle N times, where N is an integer greater than 0, to form one or more sequential flashing effects (that is a marquee flashing mode). As shown in FIG. 13B, the predetermined color light-emitting diodes 303~308 emit light once in the order of 303 to 308 at first, and then emit light once in the order of 308 to 303. That is, the predetermined color light-emitting diodes emit light from right to left and then from left to right in a cycle, to form a back-and-forth flashing lighting mode. Similarly, the predetermined color light-emitting diodes 303~308 can repeat the lighting cycle N times, and N is an integer greater than 0.

It should be noted that the lighting modes also can include time changes. In one embodiment, after the predetermined color light-emitting diodes 303~308 flash in the same order or back and forth once, they can flash again in the same order, but the flashing time or flashing frequency can be different from the previous flashing time or flashing frequency to provide different visual effects. Furthermore, when the predetermined color light-emitting diodes 303~308 emit multiple light cycles, the flashing length can gradually become longer or shorter, or the flashing frequency can gradually increase or decrease.

Figure 13C:
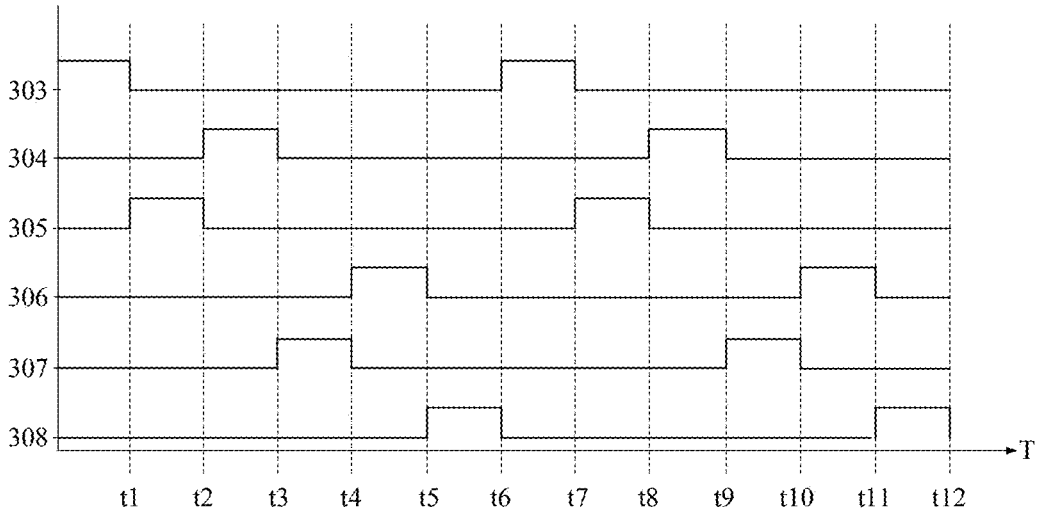

As shown in FIG. 13C, the predetermined color light-emitting diodes 303~308 sequentially emit light in the order of 303, 305, 304, 307, 306 and 308 to form a lighting cycle, and then repeat the lighting cycle N times, where N is an integer greater than 0, to form an alternating flashing pattern. The number of light emitting times and order of each predetermined color light-emitting diodes are not limited thereto. In one embodiment, the predetermined color light-emitting diodes 303~308 can each emit M times in the order described above, where M is a natural number. When M is 2, after the predetermined color light-emitting diode 303 emits light twice, the predetermined color light-emitting diode 305 emits light twice, and so on. In addition, the lighting modes can include not only sequential flashing but also simultaneous flashing. In one embodiment, K predetermined color light-emitting diodes emit light simultaneously, where K is a natural number. When K is 2, the predetermined color light-emitting diodes 303 and 305 emit light simultaneously.

Figure 13D:
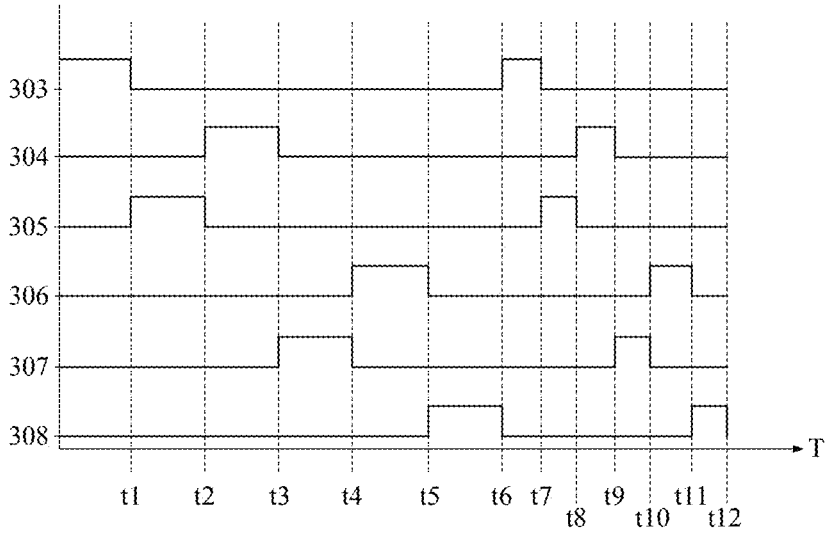

As shown in FIG. 13D, the lighting mode includes a first lighting cycle and a second lighting cycle. The first lighting cycle includes a first flashing frequency, the second lighting cycle includes a second flashing frequency, and the first flashing frequency is different from the second flashing frequency. Therefore, the predetermined color light-emitting diodes 303~308 can emit the first lighting cycle with the first flashing frequency first, and then emit the second lighting cycle with the second flashing frequency first, to form different visual effect. In addition, in one embodiment, the lighting mode includes a first lighting sequence and a second lighting sequence. The predetermined color light-emitting diodes can emit light at a fixed frequency in the first light sequence, and then emit light at a gradually changing frequency in the second light sequence.

Figure 13E:
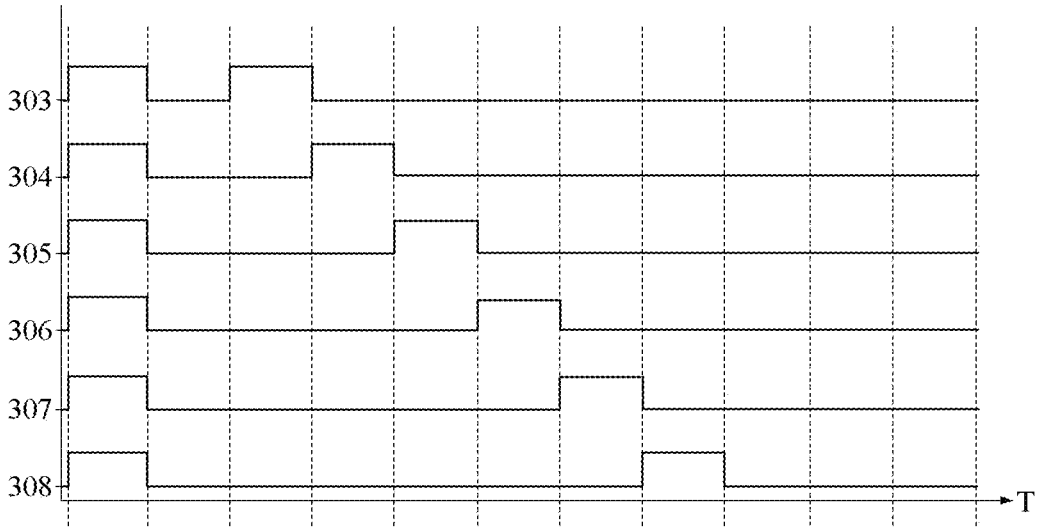

The lighting mode can also include a combination of different lighting cycles. As shown in FIG. 13E, the predetermined color light-emitting diodes 303~308 first emit light simultaneously once, then sequentially emit light once, to form a lighting cycle, and then repeats the lighting cycle for N times, where N is an integer greater than 0. In one embodiment, the predetermined color light-emitting diodes 303~308 can also emit light simultaneously L times before sequentially emitting light, where L is an integer greater than 0.

Figure 13F:
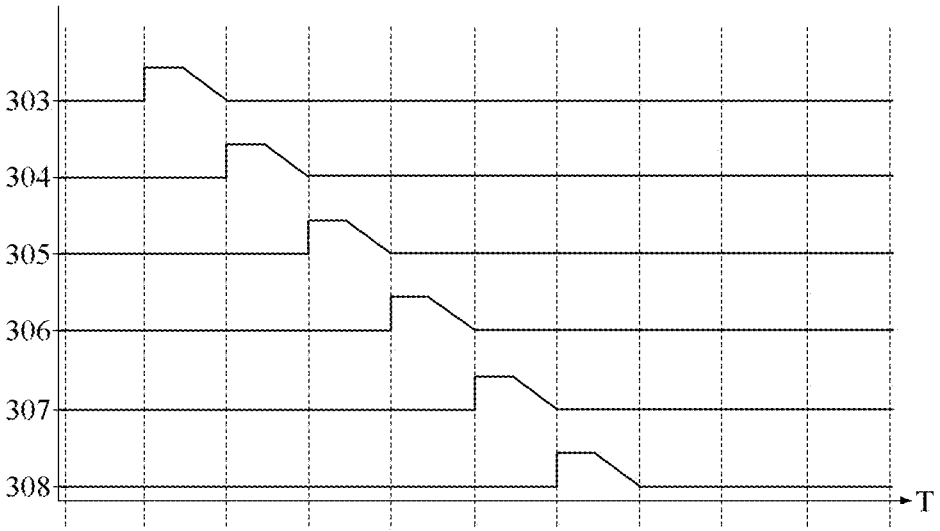
Figure 13G:
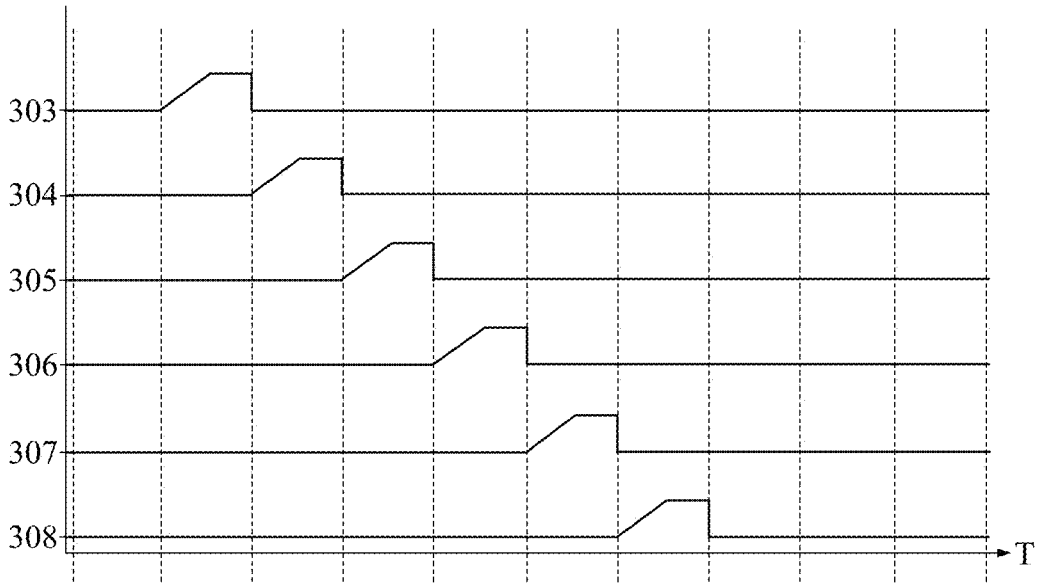

Moreover, the lighting mode also can include the control of flashing brightness. As shown in FIG. 13F, the predetermined color light-emitting diodes 303~308 can emit light to the brightest and then gradually dim. Furthermore, as shown in FIG. 13G, the predetermined color light-emitting diodes 303~308 can gradually brighten to a certain brightness and maintain the brightness for a period of time, and then be directly turned off. In practice, the time control of gradually brightening or dimming can be determined according to the requirements or design, and the lighting mode can also be that at least two predetermined color light-emitting diodes gradually brighten or dim at the same time. In addition, the lighting mode can also include gradually brightening and gradually dimming lighting. Specifically, the predetermined color light-emitting diode can gradually emit light to the certain brightness, then maintain the brightness for a period of time and then gradually dim.

Figure 13H:
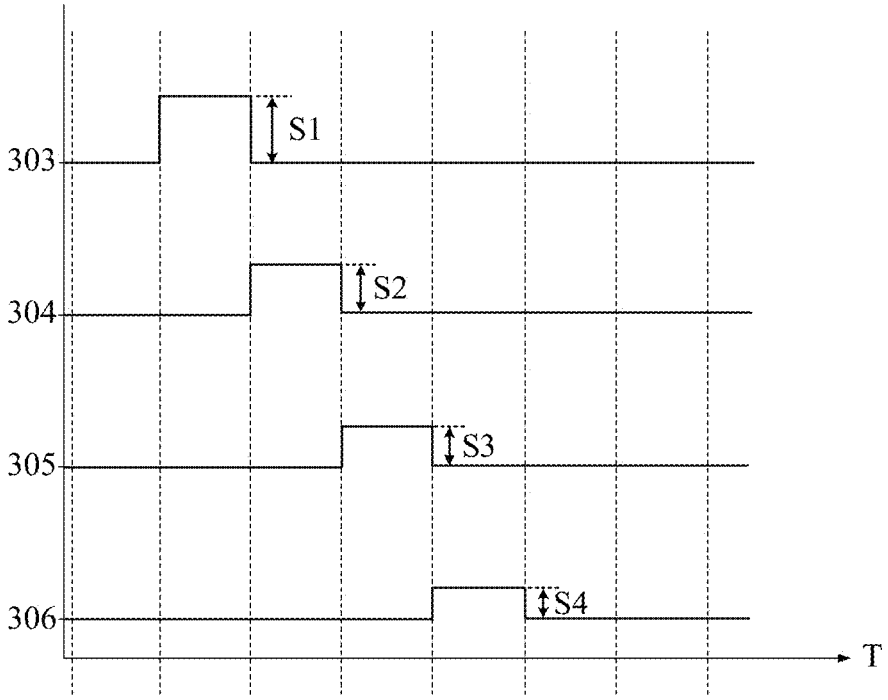

As shown in FIG. 13H, each of the predetermined color light-emitting diodes can emit light with different brightness. Wherein, the brightness of the first predetermined color light-emitting diode 303 is S1, the brightness of the second predetermined color light-emitting diode 304 is S2, the brightness of the third predetermined color light-emitting diode 305 is S3 and the brightness of the fourth predetermined color light-emitting diode 306 is S4. Therefore, the predetermined color light-emitting diodes form a lighting mode that gradually dims in sequence to provide different visual effects.

In summary, the controlling chip can store the lighting modes such as sequential flash mode, simultaneous flash mode, back and forth flash mode, alternating flash mode, marquee flash mode, frequency gradient mode, brightness gradient mode, etc. Furthermore, in practical application, those lighting modes can be combined arbitrarily. In addition to the aforementioned lighting modes, the lighting modes of the predetermined color light-emitting diodes can also include: a non-luminous interval between any two adjacent predetermined color light-emitting diodes of lighting periods, no non-luminous interval between any two predetermined color light-emitting diodes of lighting periods, or partial overlap between any two predetermined color light-emitting diodes of lighting periods.

Please refer to FIG. 3A to FIG. 3C. In this embodiment, the sensor 309 can be a vibration sensor or a spring sensor, and can generate different controlling signals according to different degrees of the external force. The controlling chip 310 can select different lighting modes corresponding to different controlling signals. For example, when the sensor 309 senses the small external force (such as the sensor 309 is touched by hands) to generate a first controlling signal, the controlling chip 310 selects the first lighting mode according to the first controlling signal generated by the sensor 309 to drive the predetermined color light-emitting diodes to emit light. When the sensor 309 senses the great external force to generate a second controlling signal, the controlling chip 310 selects the second lighting mode according to the second controlling signal generated by the sensor 309 to drive the predetermined color light-emitting diodes to emit light. The number, arrangement, color and lighting mode of the predetermined color light-emitting diodes of the present invention are not limited to the above-mentioned embodiments. The various types of luminous devices and lighting modes can be design according to requirements.

In one embodiment, the luminous device 30 of the present invention further includes a counter (now shown in figure), and the counter can be disposed on the circuit board module 301 or integrated in the controlling chip 310. The counter can calculate the times of the controlling signals generated by the sensor 309 to generate a counting signal, and the controlling chip 310 can select the lighting mode according to the controlling signal and the counting signal to drive the predetermined color light-emitting diodes 303~308 to emit light. Furthermore, the counter can also pre-store a bit threshold value. When the time of the controlling signals is greater than the bit threshold value, the counter will generate the counting signal. For example, the counter is 2 bits and the bit threshold value is 2. When the value is 0 or 1, the counter will not generate the counting signal, and the counter will generate the counting signal when the value is 2 or 3. Moreover, the counter can also pre-store a plurality of bit threshold values. The counter is 3 bits and the bit threshold values include 3 and 6. The counter will not generate the counting signal when the values are 0~2, the counter will generate a first counting signal when the values are 3~5, and the counter will generate a second counting signal when the values are 6~7. In practice, when the controlling chip 310 only receives the controlling signal, the controlling chip 310 will select the first lighting mode to drive the predetermined color light-emitting diodes 303~308 to emit light. When the controlling chip 310 receives the controlling signal and the first counting signal, the controlling chip 310 will select the second lighting mode to drive the predetermined color light-emitting diodes 303~308 to emit light. When the controlling chip 310 receives the controlling signal and the second counting signal, the controlling chip 310 will select the third lighting mode to drive the predetermined color light-emitting diodes 303~308 to emit light.

In one embodiment, the luminous device 30 further includes a signal receiver (not shown in figure) disposed on the circuit board module 301 or integrated in the controlling chip 310. The signal receiver can be communicated with the smart handheld device of the user in wire or wireless connection manner, and the smart handheld device can transmit different flashing modes or lighting modes to the controlling chip 310.

Figure 14A:
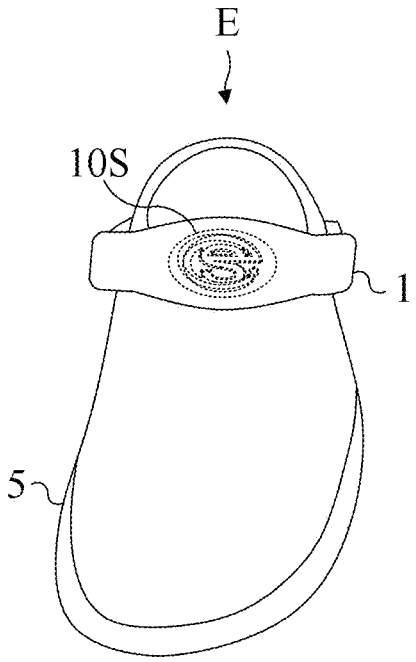
FIG. 14A is a schematic diagram illustrating a shoe with luminous shoe strap in an embodiment of the present invention.
Figure 14B:
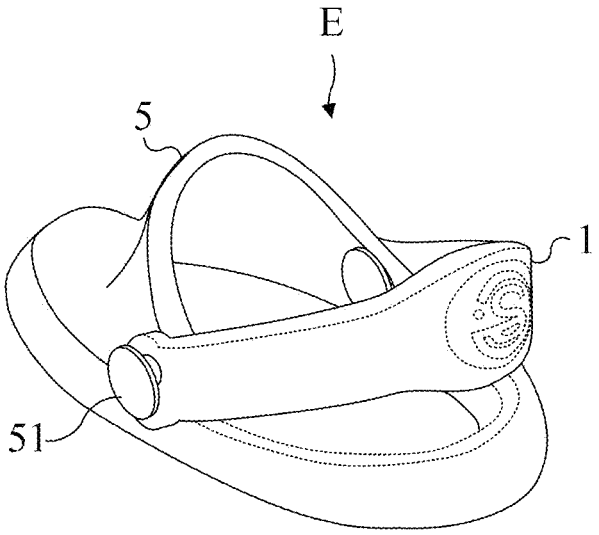
FIG. 14B is a schematic diagram illustrating the shoe with luminous shoe strap in another perspective of FIG. 14A.

The present invention provides a shoe with luminous shoe strap. Please refer to FIG. 14A and FIG. 14B. FIG. 14A is a schematic diagram illustrating a shoe E with luminous shoe strap 1 in an embodiment of the present invention. FIG. 14B is a schematic diagram illustrating the shoe E with luminous shoe strap 1 in another perspective of FIG. 14A. As shown in FIG. 14A and FIG. 14B, the shoe E with luminous shoe strap 1 includes a shoe body 5, the luminous shoe strap 1 and a joint component 51. The shoe body 5 and the luminous shoe strap 1 can include holes corresponding to and match up with the joint component 51, and the joint component 51 can fixed in the holes, so that the luminous shoe strap 1 can be installed on the shoe body 5. In addition, the joint component 51 can be pivoted in the holes of the luminous shoe strap 1, so that the luminous shoe strap 1 can rotate to adjust angle, to provide users with different wearing experiences and effects. When the sensor of the luminous shoe strap 1 detects the external force generated by walking or running to generate the controlling signal, the controlling chip receives the controlling signal and selects the lighting mode according to the controlling signal, and then controls the battery and the predetermined color light-emitting diodes to emit light with the lighting mode. In addition, the luminous shoe strap 1 also can include a raised accommodation area 10S, and the aforementioned sensor and signal receiver can be arranged at a position corresponding to the raised accommodation area 10S.

Please refer to FIG. 9A to FIG. 9G and FIG. 15. FIG. 15 is a schematic diagram illustrating the shoe E' with luminous shoe strap 3' in an embodiment of the present invention. As shown in FIG. 9A to FIG. 9G and FIG. 15, the shoe E' with luminous shoe strap 3' includes a shoe body 5', the luminous shoe strap 3' and the joint component 51'. The shoe body 5' and can include holes corresponding to and match up with the joint component 51', and the joint component 51' can fixed in the holes from the inner side, so that the luminous shoe strap 3' can be installed on the shoe body 5. When the sensor of the luminous shoe strap 3' detects the external force generated by walking or running to generate the controlling signal, the controlling chip receives the controlling signal and selects the lighting mode according to the controlling signal, and then controls the battery and the predetermined color light-emitting diodes to emit light with the lighting mode all over the luminous shoe strap 3'.

In summary, the luminous shoe strap of the present invention combines the flexible circuit board or the rigid circuit board with the flexible cable with the strap body and strip component of polymer materials (such as silicone, rubber, nylon, etc.), achieving the lightweight design. Furthermore, the circuit configuration and architecture of the circuit board of the luminous shoe strap allow the battery, the predetermined color light-emitting diodes, the sensor and the controlling chip to be installed directly on the circuit board without the external wires, thereby reducing the overall size and meeting the diverse shoelace size requirements of different age groups and foot shapes. Furthermore, the luminous shoe strap also can provide multiple lighting modes without increasing circuit complexity or adding external wires, allowing the controlling chip to select the corresponding lighting mode based on the controlling signal detected by the sensor. In addition, the luminous shoe strap also can be integrated on the shoe to provide a variety of lighting modes and practicality.

With the examples and explanations mentioned above, the features and spirits of the invention are hopefully well described. More importantly, the present invention is not limited to the embodiment described herein. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A luminous shoe strap, comprising:

a strap body, having a surface;

a strip component, coupled to the strap body; and a luminous device, configured between the strap body and the strip component, the luminous device comprising:

a circuit board module;

a battery, configured on the circuit board module;

a plurality of predetermined color light-emitting diodes, electrically coupled to the circuit board module and the battery, the plurality of predetermined color light-emitting diodes comprising a first predetermined color light-emitting diode and a second predetermined color light-emitting diode, the first predetermined color light-emitting diode comprising a first light-emitting diode chip and a first phosphor layer coated on the first light-emitting diode chip, the second predetermined color light-emitting diode comprising a second light-emitting diode chip, wherein each of the predetermined color light-emitting diodes has the same or substantially the same driving voltage;

a sensor, coupled to the circuit board module and configured to sense an external force to generate a controlling signal; and a controlling chip, configured on the circuit board module and electronically connected to the battery, the plurality of predetermined color light-emitting diodes and the sensor, the controlling chip being configured to receive the controlling signal and drive the plurality of predetermined color light-emitting diodes to emit light with a lighting mode according to the controlling signal;

wherein, the circuit board module is a flexible circuit board or a rigid circuit board with a flexible cable.

2. The luminous shoe strap of claim 1, wherein the strap body has a groove formed on the surface, and the groove comprises a first groove and a second groove communicated with each other, the luminous device is configured in the first groove and the second groove.

3. The luminous shoe strap of claim 2, wherein:

when the circuit board module is the flexible circuit board, the first groove is configured to contain the battery and portion of the flexible circuit board, and the second groove is configured to contain the other portion of the flexible circuit board; or when the circuit board module is the rigid circuit board with the flexible cable, the first groove is configured to contain the rigid circuit board, and the second groove is configured to contain the flexible cable.

4. The luminous shoe strap of claim 3, wherein the circuit board module is the flexible circuit board, the plurality of predetermined color light-emitting diodes are configured on a first surface of the flexible circuit board, the battery is configured on a second surface corresponding to the first surface of the flexible circuit board, the flexible circuit board further comprises a first connecting component and a second connecting component, the first connecting component is connected to a first electrode of the battery and bypasses a side wall of the battery, the second connecting component is connected to a second electrode of the battery but not bypasses the side wall of the battery.

5. The luminous shoe strap of claim 3, wherein the circuit board module is the flexible circuit board, the flexible circuit board further comprises a first connecting component and a second connecting component, one end of the first connecting component is welded on a first surface of the flexible circuit board, one end of the second connecting component passes through the flexible circuit board and is welded on the first surface of the flexible circuit board, a case of the sensor is electronically connected to the first surface of the flexible circuit board, an electrode of the sensor is electronically connected to one of the first surface and the second surface of the flexible circuit board.

6. The luminous shoe strap of claim 5, wherein the depth of the first groove is greater than the depth of the second groove.

7. The luminous shoe strap of claim 4, wherein the circuit board module is the flexible circuit board, the flexible circuit board comprises a slot, the sensor is configured in the slot, and the width of the slot is smaller than the width of the sensor; wherein the width of the flexible circuit board is smaller than the width or diameter of the battery, and the length of the flexible circuit board is greater than the width or diameter of the battery.

8. The luminous shoe strap of claim 3, wherein the circuit board module is the rigid circuit board with the flexible cable, the sensor and the controlling chip are configured on a first surface of the rigid circuit board, the plurality of predetermined color light-emitting diodes are configured on the flexible cable and/or the first surface of the rigid circuit board, the battery is configured on a second surface corresponding to the first surface of the rigid circuit board.

9. The luminous shoe strap of claim 8, wherein the circuit board module is the rigid circuit board with the flexible cable, the rigid circuit board further comprises a first connecting component and a second connecting component, the first connecting component is connected to a first electrode of the battery and bypasses a side wall of the battery, the second connecting component is connected to a second electrode of the battery but not bypass the side wall of the battery.

10. The luminous shoe strap of claim 2, wherein the strap body further comprises a first end and a second end, no hole in the first end and the second end of the strap body, and the strip component further comprises two holes corresponding to the first end and the second end, the luminous shoe strap further comprises two joint components coupled to the two holes of the strip component respectively.

11. The luminous shoe strap of claim 10, wherein two of the predetermined color light-emitting diodes are located corresponding to the first end and the second end respectively.

12. The luminous shoe strap of claim 10, wherein the luminous device further comprises a switch configured on the circuit board module and electronically connected to the battery and the controlling chip, the switch and one of the predetermined color light-emitting diodes are located corresponding to the first end and the second end respectively.

13. The luminous shoe strap claim 1, wherein the lighting color of the first predetermined color light-emitting diode is different from the lighting color of the second predetermined color light-emitting diode, the lighting color of the first predetermined color light-emitting diode is red-tinted, green-tinted, yellow-tinted, orange-tinted, cyan green-tinted, lime green-tinted, purple-tinted, pink-tinted, ice blue-tinted, or white-tinted; wherein the first light-emitting diode chip and the second light-emitting diode chip are blue light-emitting diode chips, and the second predetermined color light-emitting diode is not coated with a phosphor layer.

14. The luminous shoe strap claim 1, wherein the plurality of predetermined color light-emitting diodes further comprise a third predetermined color light-emitting diode, the third predetermined color light-emitting diode comprises a third light-emitting diode chip and a third phosphor layer coated on the third light-emitting diode chip, wherein the lighting color of the third predetermined color light-emitting diode is different from the light color of the second predetermined color light-emitting diode.

15. The luminous shoe strap claim 1, wherein the lighting color of the first predetermined color light-emitting diode is orange-tinted, cyan green-tinted, lime green-tinted, purple-tinted, pink-tinted, ice blue-tinted, or white-tinted, the second predetermined color light-emitting diode further comprises a second phosphor layer coated on the second light-emitting diode chip, and the lighting color of the second predetermined color light-emitting diode is orange-tinted, cyan green-tinted, lime green-tinted, purple-tinted, pink-tinted, ice blue-tinted, or white-tinted; wherein both of the first light-emitting diode chip and the second light-emitting diode chip are blue light-emitting diode chips.

16. The luminous shoe strap claim 1, wherein the lighting mode comprises one of a sequential flashing mode, a synchronous flashing mode, a reciprocating flashing mode, an alternating flashing mode, a marquee flashing mode, a gradual brightening and dimming mode, and a gradual dimming and brightening mode.

17. A shoe with luminous shoe strap, comprising:

a shoe body;

a luminous shoe strap, coupled to the shoe body, the luminous shoe strap comprising:

a strap body, being elongated shape and having a surface;

a strip component, coupled to the strap body; and a luminous device, configured between the strap body and the strip component, the luminous device comprising:

a circuit board module;

a battery, configured on the circuit board module;

a plurality of predetermined color light-emitting diodes, electrically coupled to the circuit board module and the battery, the plurality of predetermined color light-emitting diodes comprising a first predetermined color light-emitting diode and a second predetermined color light-emitting diode, the first predetermined color light-emitting diode comprising a first light-emitting diode chip and a first phosphor layer coated on the first light-emitting diode chip, the second predetermined color light-emitting diode comprising a second light-emitting diode chip, wherein each of the predetermined color light-emitting diodes has the same or substantially the same driving voltage;

a sensor, coupled to the circuit board module and configured to sense an external force to generate a controlling signal; and a controlling chip, configured on the circuit board module and electronically connected to the battery, the plurality of predetermined color light-emitting diodes and the sensor, the controlling chip being configured to receive the controlling signal and drive the plurality of predetermined color light-emitting diodes to emit light with a lighting mode according to the controlling signal;

wherein, the circuit board module is a flexible circuit board or a rigid circuit board with a flexible cable.

18. The shoe with luminous shoe strap of claim 17, wherein the strap body has a groove formed on the surface, and the groove comprises a first groove and a second groove communicated with each other, the luminous device is configured in the first groove and the second groove.

19. The shoe with luminous shoe strap of claim 18, wherein:

when the circuit board module is the flexible circuit board, the first groove is configured to contain the battery and portion of the flexible circuit board, and the second groove is configured to contain the other portion of the flexible circuit board; or when the circuit board module is the rigid circuit board with the flexible cable, the first groove is configured to contain the rigid circuit board, and the second groove is configured to contain the flexible cable.

20. The shoe with luminous shoe strap of claim 19, wherein the circuit board module is the flexible circuit board, the plurality of predetermined color light-emitting diodes are configured on a first surface of the flexible circuit board, the battery is configured on a second surface corresponding to the first surface of the flexible circuit board, the flexible circuit board further comprises a first connecting component and a second connecting component, the first connecting component is connected to a first electrode of the battery and bypasses a side wall of the battery, the second connecting component is connected to a second electrode of the battery but not bypass the side wall of the battery.

21. The shoe with luminous shoe strap of claim 19, wherein the circuit board module is the flexible circuit board, the flexible circuit board further comprises a first connecting component and a second connecting component, one end of the first connecting component is welded on a first surface of the flexible circuit board, one end of the second connecting component passes through the flexible circuit board and is welded on the first surface of the flexible circuit board, a case of the sensor is electronically connected to the first surface of the flexible circuit board, an electrode of the sensor is electronically connected to one of the first surface and the second surface of the flexible circuit board.

22. The shoe with luminous shoe strap of claim 21, wherein the circuit board module is the flexible circuit board, the flexible circuit board comprises a slot, the sensor is configured in the slot, and the width of the slot is smaller than the width of the sensor; wherein the width of the flexible circuit board is smaller than the width or diameter of the battery, and the length of the flexible circuit board is greater than the width or diameter of the battery.

23. The shoe with luminous shoe strap of claim 19, wherein the circuit board module is the rigid circuit board with the flexible cable, the sensor and the controlling chip are configured on a first surface of the rigid circuit board, the plurality of predetermined color light-emitting diodes are configured on the flexible cable and/or the first surface of the rigid circuit board, the battery is configured on a second surface corresponding to the first surface of the rigid circuit board.

24. The shoe with luminous shoe strap of claim 23, wherein the circuit board module is the rigid circuit board with the flexible cable, the rigid circuit board further comprises a first connecting component and a second connecting component, the first connecting component is connected to a first electrode of the battery and bypasses a side wall of the battery, the second connecting component is connected to a second electrode of the battery but not bypass the side wall of the battery.

25. The shoe with luminous shoe strap of claim 17, wherein the strap body further comprises a plurality of first holes, the strip component further comprises a plurality of second holes corresponding to the first holes, the first holes and the second holes are configured to connect a plurality of joint components to install the luminous shoe strap on the shoe body.

26. The shoe with luminous shoe strap of claim 17, wherein the strap body further comprises a first end and a second end, no hole in the first end and the second end of the strap body, and the strip component further comprises two holes corresponding to the first end and the second end respectively, the two holes are configured to connect a plurality of joint components to install the luminous shoe strap on the shoe body.

27. The shoe with luminous shoe strap of claim 26, wherein the luminous device further comprises a switch configured on the circuit board module and electronically connected to the battery and the controlling chip, the switch or one of the predetermined color light-emitting diodes are located corresponding to the first end.

28. The shoe with luminous shoe strap of claim 17, wherein the lighting color of the first predetermined color light-emitting diode is different from the lighting color of the second predetermined color light-emitting diode, the lighting color of the first predetermined color light-emitting diode is red-tinted, green-tinted, yellow-tinted, orange-tinted, cyan green-tinted, lime green-tinted, purple-tinted, pink-tinted, ice blue-tinted, or white-tinted; wherein the first light-emitting diode chip and the second light-emitting diode chip are blue light-emitting diode chips, and the second predetermined color light-emitting diode is not coated with a phosphor layer.

29. The shoe with luminous shoe strap of claim 17, wherein the plurality of predetermined color light-emitting diodes further comprise a third predetermined color light-emitting diode, the third predetermined color light-emitting diode comprises a third light-emitting diode chip and a third phosphor layer coated on the third light-emitting diode chip, wherein the lighting color of the third predetermined color light-emitting diode is different from the light color of the second predetermined color light-emitting diode.

30. The shoe with luminous shoe strap of claim 17, wherein the lighting color of the first predetermined color light-emitting diode is orange-tinted, cyan green-tinted, lime green-tinted, purple-tinted, pink-tinted, ice blue-tinted, or white-tinted, the second predetermined color light-emitting diode further comprises a second phosphor layer coated on the second light-emitting diode chip, and the lighting color of the second predetermined color light-emitting diode is orange-tinted, cyan green-tinted, lime green-tinted, purple-tinted, pink-tinted, ice blue-tinted, or white-tinted; wherein both of the first light-emitting diode chip and the second light-emitting diode chip are blue light-emitting diode chips.

31. The shoe with luminous shoe strap of claim 17, wherein the lighting mode comprises one of a sequential flashing mode, a synchronous flashing mode, a reciprocating flashing mode, an alternating flashing mode, a marquee flashing mode, a gradual brightening and dimming mode, and a gradual dimming and brightening mode.

* * * * *